US006519982B1

(12) United States Patent
Brammall et al.

(10) Patent No.: US 6,519,982 B1
(45) Date of Patent: Feb. 18, 2003

(54) BOLT SEAL PROTECTOR

(75) Inventors: Terrence N. Brammall, Angola, IN (US); Jeffrey Eugene Warner, Fremont, IN (US); Rodney Ridenour, Fremont, IN (US); William J. Neely, Fremont, IN (US)

(73) Assignee: Trans-Guard Industries, Inc., Angola, IN (US)

( * ) Notice: Subject to any disclaimer, the term of this patent is extended or adjusted under 35 U.S.C. 154(b) by 0 days.

(21) Appl. No.: 09/971,979

(22) Filed: Oct. 5, 2001

(51) Int. Cl.[7] ..... E05B 67/38

(52) U.S. Cl. ..... 70/56; 70/212; 70/417; 292/205

(58) Field of Search ..... 70/54–56, DIG. 43, 70/DIG. 56, 417, 202, 203, 211, 212; 292/205, 218, DIG. 32, DIG. 36

(56) References Cited

U.S. PATENT DOCUMENTS

| | | | | | |
|---|---|---|---|---|---|
| 4,106,315 | A | * | 8/1978 | Dohanyos | 70/56 |
| 4,898,008 | A | * | 2/1990 | Eberly | 70/56 |
| 4,977,763 | A | * | 12/1990 | Sewell | 70/54 |
| 5,118,149 | A | | 6/1992 | Emmons | 292/327 |
| 5,154,458 | A | * | 10/1992 | Cook et al. | 292/218 |
| 5,477,710 | A | * | 12/1995 | Stefanutti | 70/56 |
| 5,732,989 | A | | 3/1998 | Stevenson et al. | 292/327 |
| 5,737,946 | A | * | 4/1998 | Sole et al. | 70/54 |
| 5,743,118 | A | * | 4/1998 | Anderson | 70/56 |
| 5,749,610 | A | | 5/1998 | Brammal et al. | 292/327 |
| 5,878,604 | A | | 3/1999 | Stone et al. | 70/56 |
| 5,975,595 | A | * | 11/1999 | Lorenzo | 292/205 |
| 6,009,731 | A | * | 1/2000 | Emmons et al. | 70/56 |
| 6,010,166 | A | | 1/2000 | Hamilton et al. | 292/282 |
| 6,036,240 | A | * | 3/2000 | Hamilton et al. | 292/202 |
| 6,357,266 | B1 | * | 3/2002 | Van Buren | 70/56 |

* cited by examiner

*Primary Examiner*—Lloyd A. Gall
(74) *Attorney, Agent, or Firm*—Carella, Byrne, Bain, Gilfillan, Cecchi et; John G. Gilfillan, III; William Squire

(57) ABSTRACT

A bolt seal protector includes a V-shape or trapezoidal shape set of side and front walls. A set of transverse walls are attached to the side walls in the interior space defined by the side and front walls and include bolt shank receiving apertures. The transverse walls are attached to the side walls by projections. Top and bottom walls may be provided to enhance security. Flanges may be attached to the side walls. The flanges may extend inwardly or outwardly relative to the interior space at the top and bottom side wall edges. The transverse walls are recessed for receiving the bracket of a hasp of a keeper bar assembly which hasp is received between the transverse walls. Slots are provided in the side walls to receive a keeper bar handle and to provide clearance for hasp bracket fasteners and the like. Different thickness walls and flange shapes are provided for a given security need. Different embodiments are disclosed including a tool for use with certain of the embodiments.

34 Claims, 15 Drawing Sheets

FIG. 4a
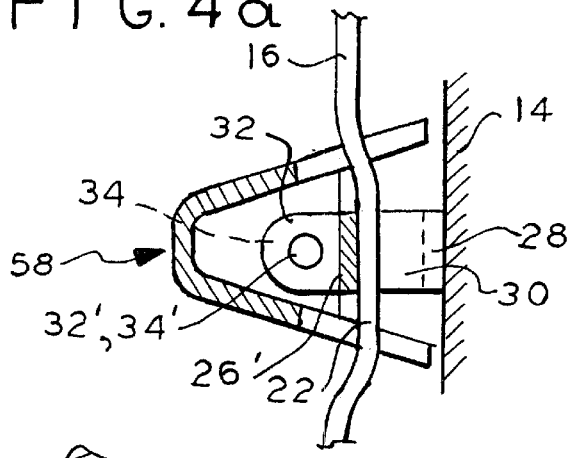
FIG. 1
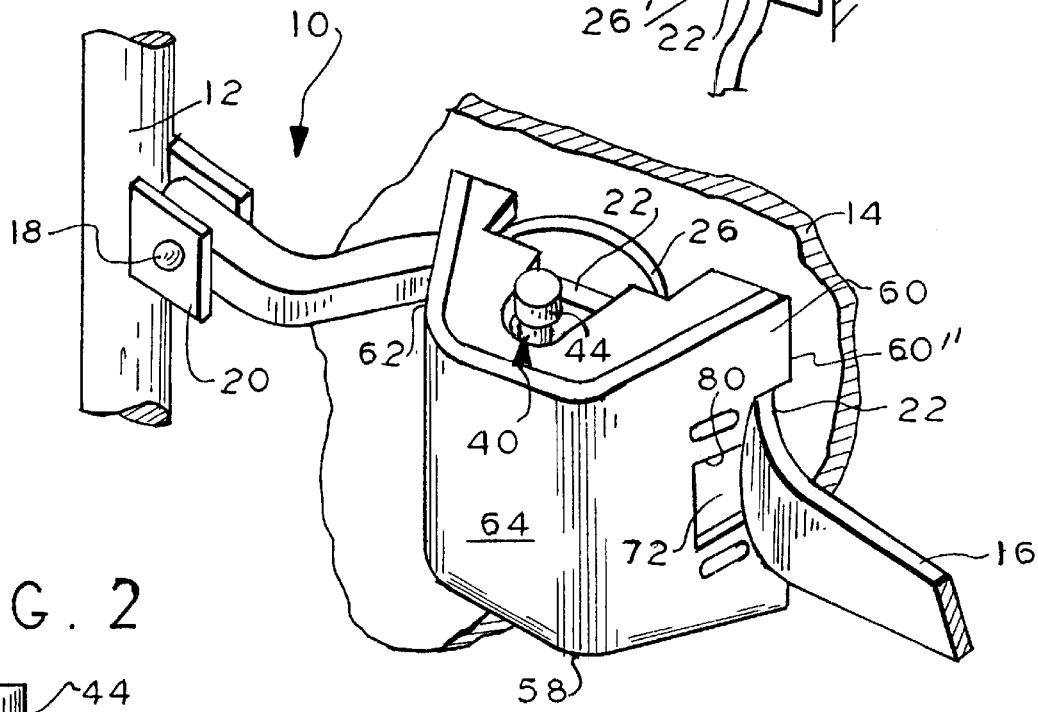
FIG. 2
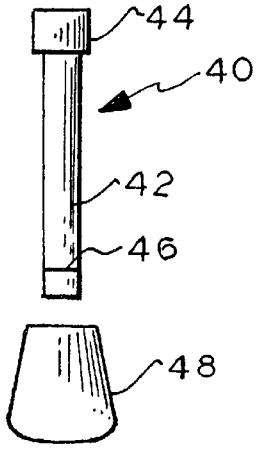
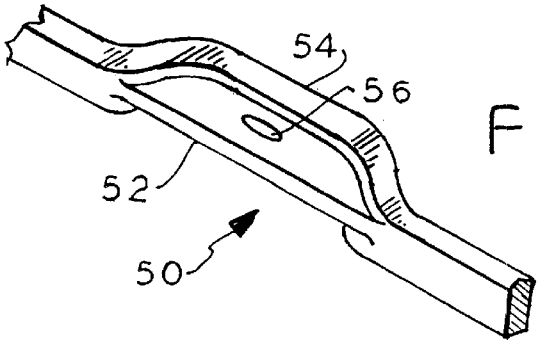
FIG. 4c 208
254
250
226
204
214
202
238
248
15
15
230
229
246
218
242
222
203
15a
15a
220
224
216
244
16
16
228
262
258
210
212
205
240
206
260
231
232

256
254
252
226
204
246
202
212
234'
208
210
254
234
244
242
203
205
216
236
236'
206

FIG. 17
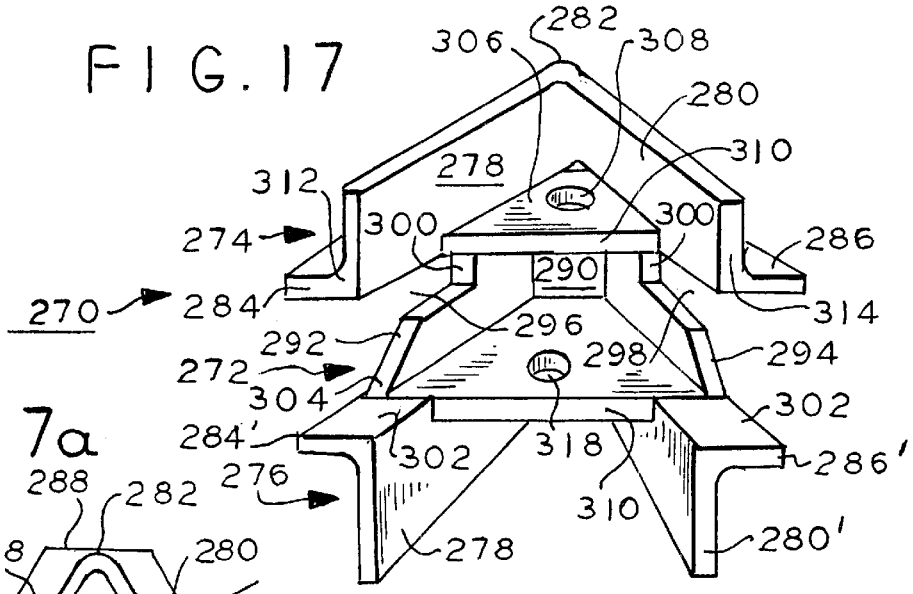
FIG. 17a
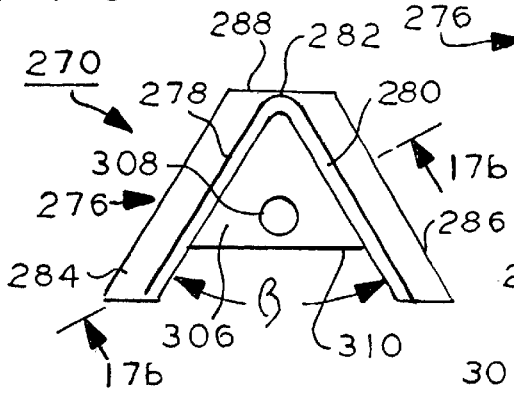
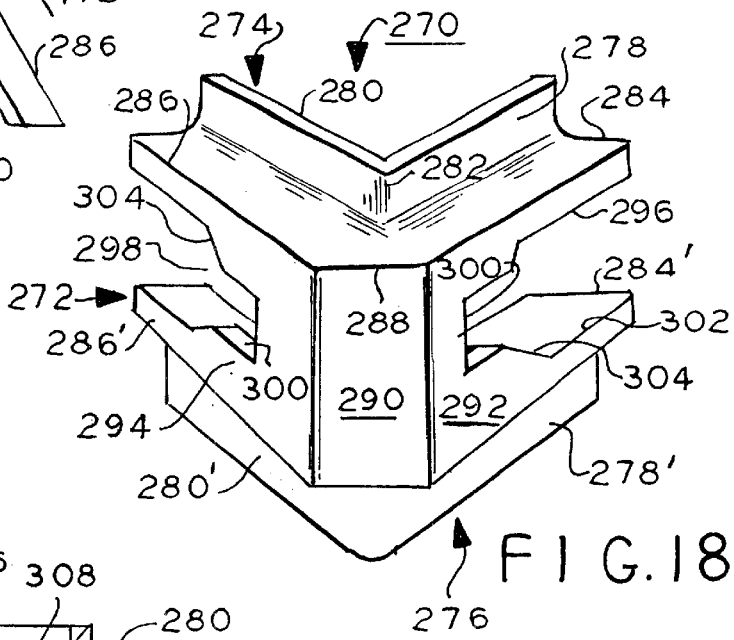
FIG. 18
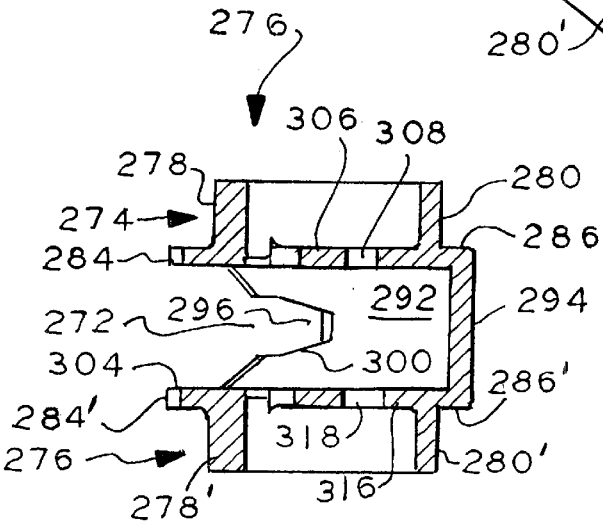
FIG. 17b

FIG. 19
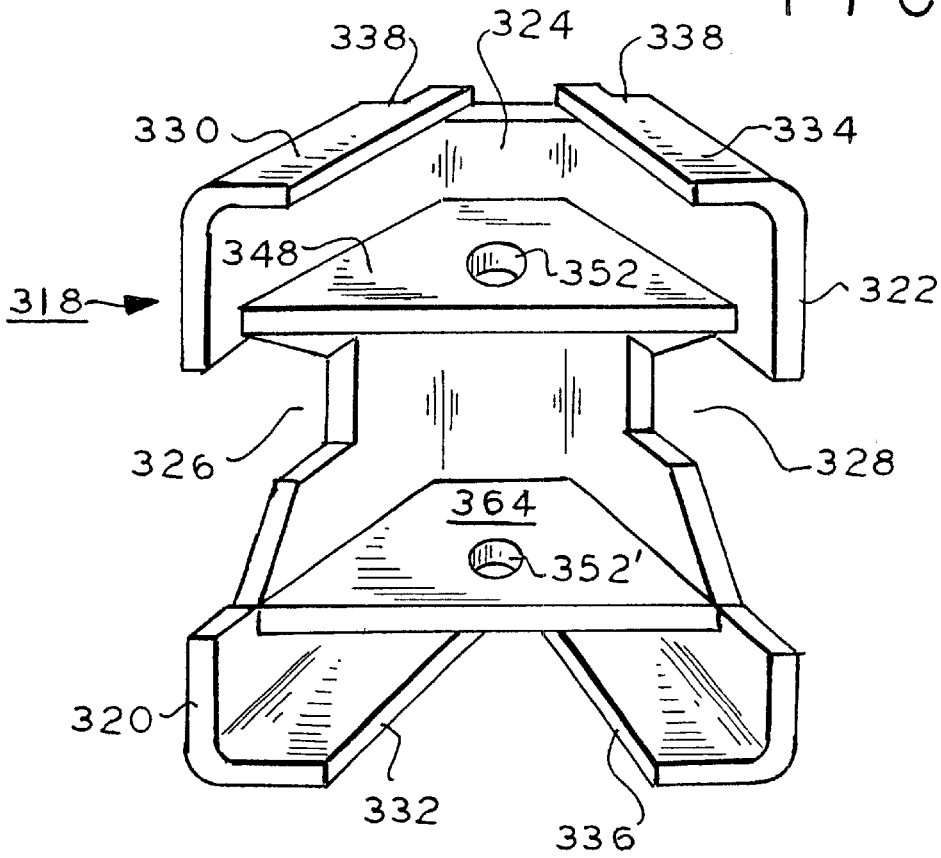
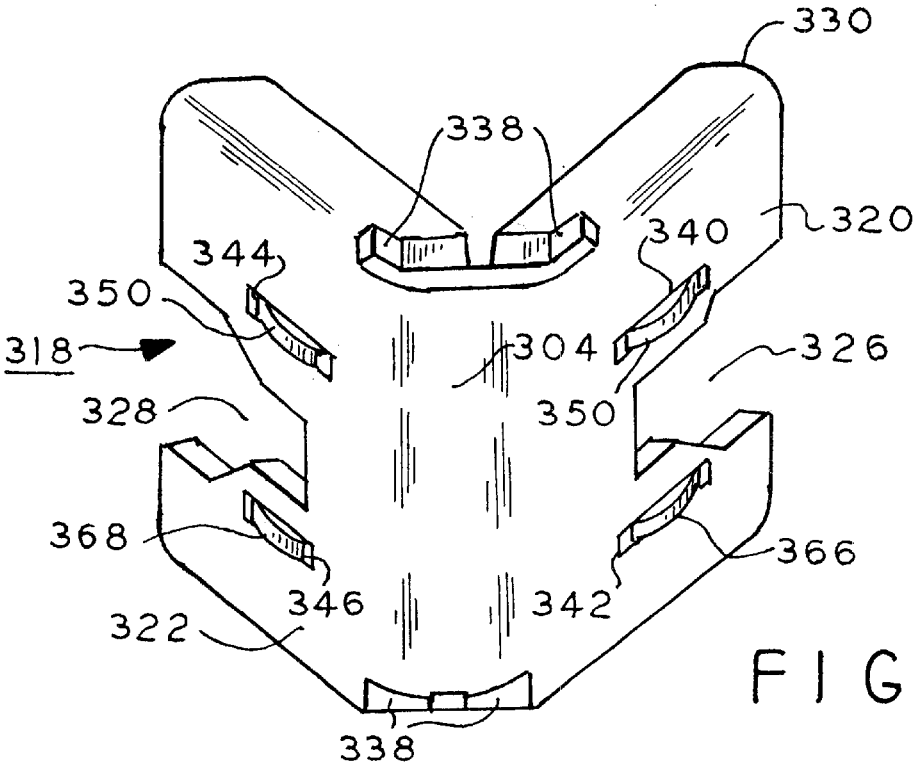
FIG. 20

BOLT SEAL PROTECTOR

CROSS REFERENCE TO RELATED PATENTS

Of interest are commonly owned U.S. Pat. Nos. 5,347,689 and 5,413,393 ('393) disclosing reusable bolt seals, U.S. Pat. Nos. 5,127,687, 4,802,700, 5,450,657, 5,582,447, 5,749,610, and 5,732,989 disclosing locking seals including a cylindrical member and a lock body, U.S. Pat. Nos. 5,118,149, 5,878,604, 6,036,240, 6,010,166 disclosing a container or door hasp protector, and U.S. Pat. No. 6,009,731 ('731) disclosing a locking device for a door keeper bar, all incorporated by reference herein in their entirety.

This invention relates to bolt seal protectors, and more particularly, robust steel housings for protecting hasps and attached bolt seals having a head, shank and lock body from tampering.

Cargo shipping vehicles such as trucks and cargo shipping containers and the like are subject to widespread tampering due to the value of the cargo. The vehicles and containers have doors which are locked shut with hasps and secured with locking seals. Such seals include a steel bolt having a head and shank which is attached to a locking body having a shank locking mechanism. When the shank is inserted into the body, a locking collet or other arrangement permanently locks the shank to the body. To preclude tampering, protective casings are provided to protect the seals. For example, reference is made to the above noted commonly owned US patents for the disclosure of various seals and protector devices of the type described.

In some environments, doors on cargo containers and trucks employ keeper bars. Such keeper bars and protector devices are disclosed for example in the above U.S. Pat. Nos. 6,010,166 and 6,009,731. Preferably a releasable seal is desired for such protectors to permit authorized users to access the cargo without breaking the seals. Such a reusable seal is disclosed in the above U.S. Pat. Nos. 5,878,604 ('604) and 5,732,989 ('989), for example, wherein the '604 patent discloses an example of a seal protector using the seal of the '989 patent. The seal protector must provide access for the opening tool and yet preclude access by tampering tools providing a conflict in design of the protectors.

Without such seal protectors, thieves may break open the seals by cutting the bolt shank with bolt cutters or by the use of blow torches. The protectors protect the seal shanks from such destructive devices and yet permit access to particular tools for opening the locks by authorized users. Pat. No. '393 illustrates a bolt seal and a tool for breaking the seal.

Padlock protector devices are disclosed in U.S. Pat. Nos. 4,898,008, 4,033,155, 5,146,771 and 5,477,710. These are not satisfactory for cargo shipping containers and the like because the shackles are readily exposed for destruction by tampering. Further, these devices are not disclosed as operative with bolt seals of the type described above. While the seal protectors of the commonly owned patents noted above are satisfactory, various keeper bars on cargo containers and trucks have numerous different configurations. Certain of the above described devices also require modification of the keeper bar construction such as disclosed in Pat. No. '731 in one embodiment thereof.

Various keeper bar assemblies, such as described herein in connection with FIG. 4*b*, used with the different cargo containers and cargo vehicles differ in many cases from each other. While they all have handles and hasps, the dimensional relationship of these assemblies vary among the different units. This presents a problem with providing universal bolt seal protectors for such different keeper bar assemblies. The present invention resolves this problem.

The present inventors recognize a need for a more universal casing that solves the above identified problems with the prior art seal protection devices for use on keeper bar type door arrangements.

A seal protector for protecting a locked bolt seal according to the present invention is for use with a bolt seal which comprises a shank, a head at a first shank end and a lock body for locking attachment to the shank at a second shank end, the shank for passing through a hasp having a first bolt receiving aperture, the hasp being coupled to a locking handle associated with the door, the hasp including a support bracket secured to the door.

The protector comprises a front wall and first and second side walls each extending from the front wall at a side wall front edge to a side wall rear edge and inclined relative to each other and to the front wall to form a space therebetween, the space between the side walls and front wall being one of a triangle and trapezoid, the side walls each having a slot in communication with the rear edge of each side wall for receiving the handle therein, the space having an open rear face distal the front wall for receiving the hasp therethrough.

A third wall is in the space and secured to the side walls, the third wall having a second aperture for alignment with the first aperture of the hasp received in the space. A fourth wall is in the space secured to the side walls and has a third aperture aligned with the second aperture and for alignment with the first aperture, the first, second and third apertures for receiving the bolt therethrough, the third and fourth walls defining a chamber for receiving the handle and hasp.

In one aspect, the side walls have top and bottom edges, the top edges being coextensive and the bottom edges being coextensive, the front wall extending to and between the top and bottom edges, the front wall being curved in the region between and attached to the front edges of the side walls.

In a further aspect, the side walls have rear edges lying in a plane, the third and fourth walls having respective rear edges located recessed in the space spaced from the plane for permitting the hasp bracket lying in the plane to be received in the space.

In a further aspect, the front wall defines a trough, and may be V-shaped or U-shaped.

In a still further aspect, the side walls are spaced apart a distance sufficient to receive the bracket in the space.

In a further aspect, the slots have a first portion that is trapezoidal at the side walls rear edges and rectangular second portion interior the first portion relative to the rear edges.

Preferably, the front wall comprises a planar wall of a first transverse width, the rear edges of the side walls being spaced apart a second transverse width greater than the first transverse width to form the space into a trapezoid in plan view along the plane of the front wall.

In a further aspect, further including a flange extending outwardly from each side wall away from the space. Preferably a flange extends from each side wall at a top and a bottom edge thereof either inwardly into the space or outwardly away from the space.

Preferably the side walls have top and bottom edges, and wherein each slot has a first portion in communication with its corresponding side wall rear edge, each slot having a second trapezoidal portion in communication with the first portion and interior the first portion relative to said rear edges, and each slot having a third portion interior the second portion and closest to the front wall, the first portion in a direction from the top to bottom edges having a height greater than that of the third portion, the second portion of each slot being inclined from and to each the first and third portions.

In a further aspect, the protector further includes a first flange extending outwardly from the first side wall and a second flange extending outwardly from the second side wall, a third flange extending outwardly from the first side and a fourth flange extending outwardly from the second side wall.

Preferably, the first and second flanges and third wall are coplanar and the third and fourth flanges are coplanar with the fourth wall.

In a still further aspect, the flanges each form an edge of its corresponding slot and form a continuous planar surface with the respective third and fourth walls.

Still further aspects will be apparent from the following description wherein:

IN THE DRAWING

FIG. 1 is a fragmented isometric view of an embodiment of a bolt seal protection device and bolt seal in the locked state for use with a keeper bar hasp;

FIG. 2 is a side elevation exploded diagrammatic view of a representative bolt seal for use in the embodiment of FIG. 1;

Figure 4B:
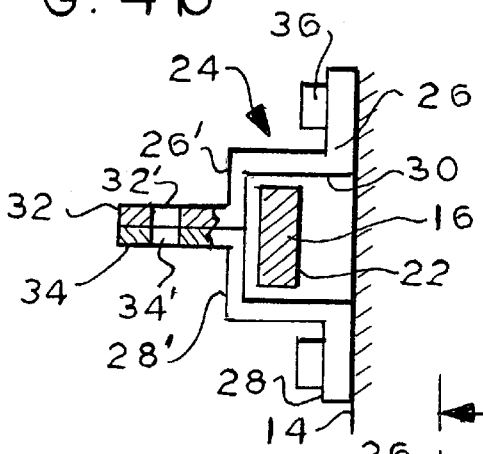
FIG. 4 is a front elevation view of the embodiment of FIG. 1 with the seal protector in place.
Figure 4:
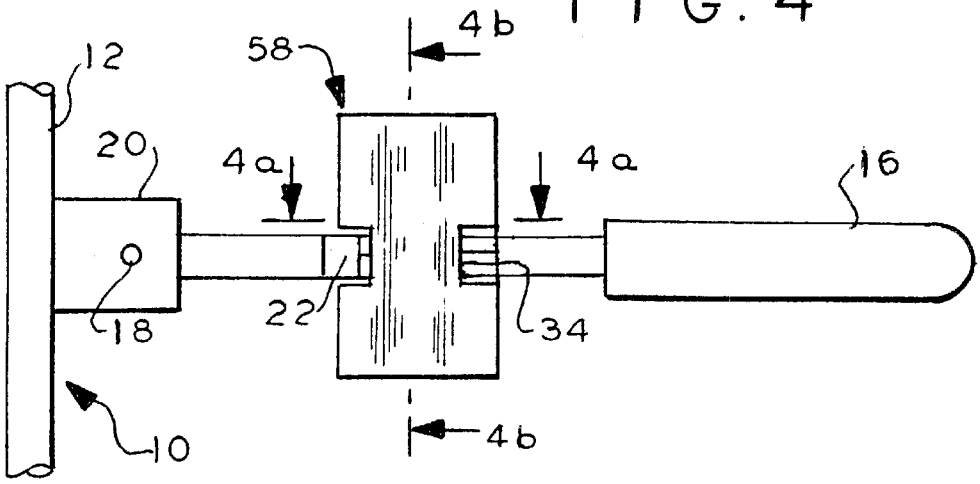

FIG. 4*a* is a sectional view of the embodiment of FIG. 4 taken along lines 4*a*—4*a;*

Figure 3:
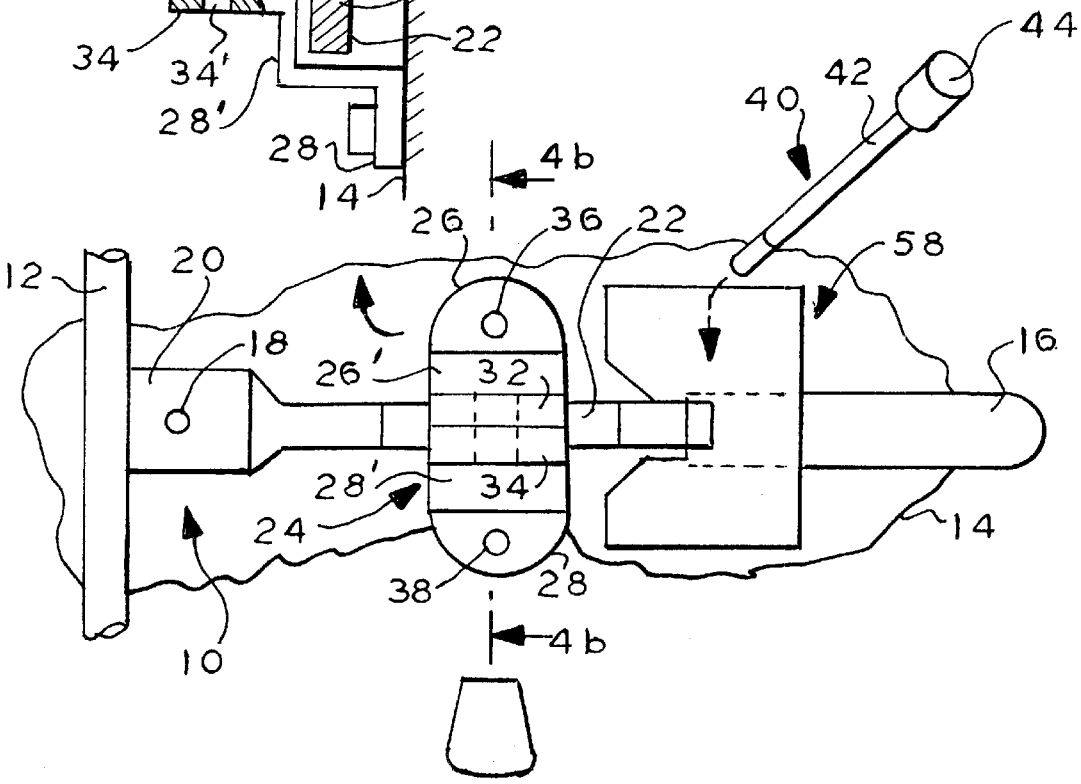
FIG. 3 is a side elevation view exploded view of the embodiment of FIG. 1 prior to locking the bolt seal and attaching the bolt seal protector to the hasp.

FIG. 4*b* is a partial sectional view of the embodiment of FIG. 3 taken along lines 4*b*—4*b;*

Figure 8:
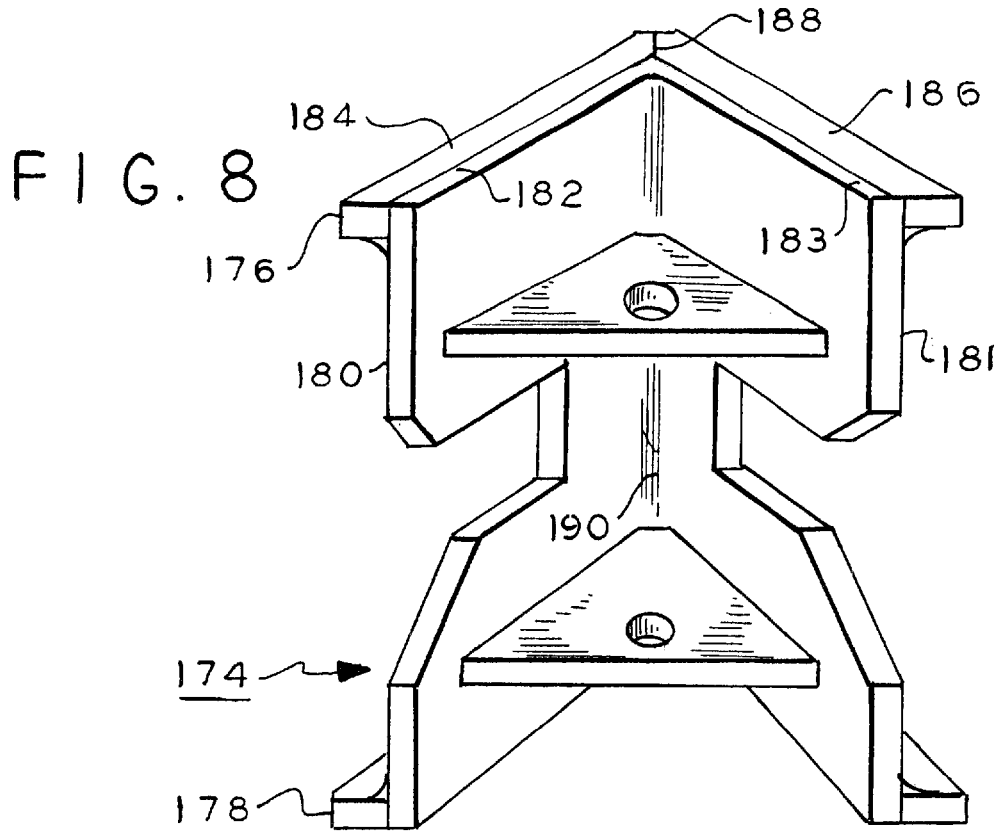
Figure 9:
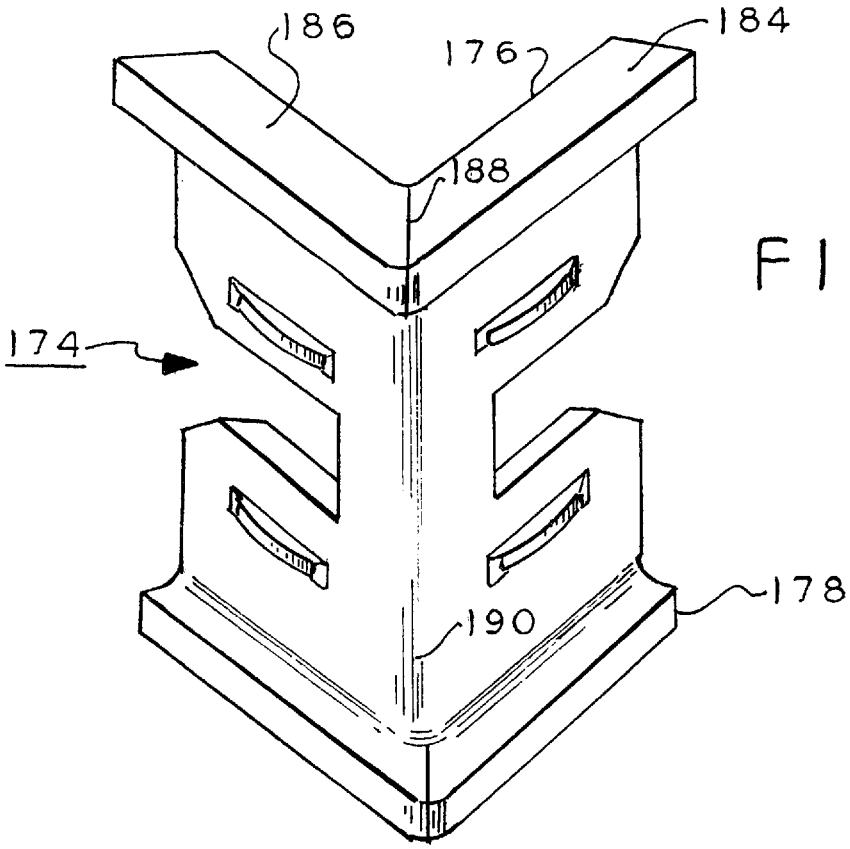
Figure 10:
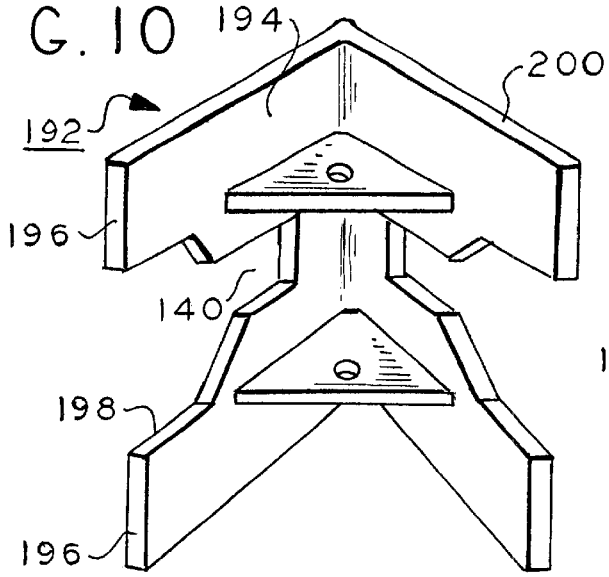
Figure 11:
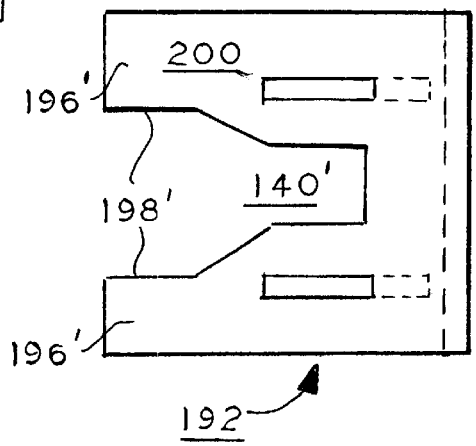
Figure 12:
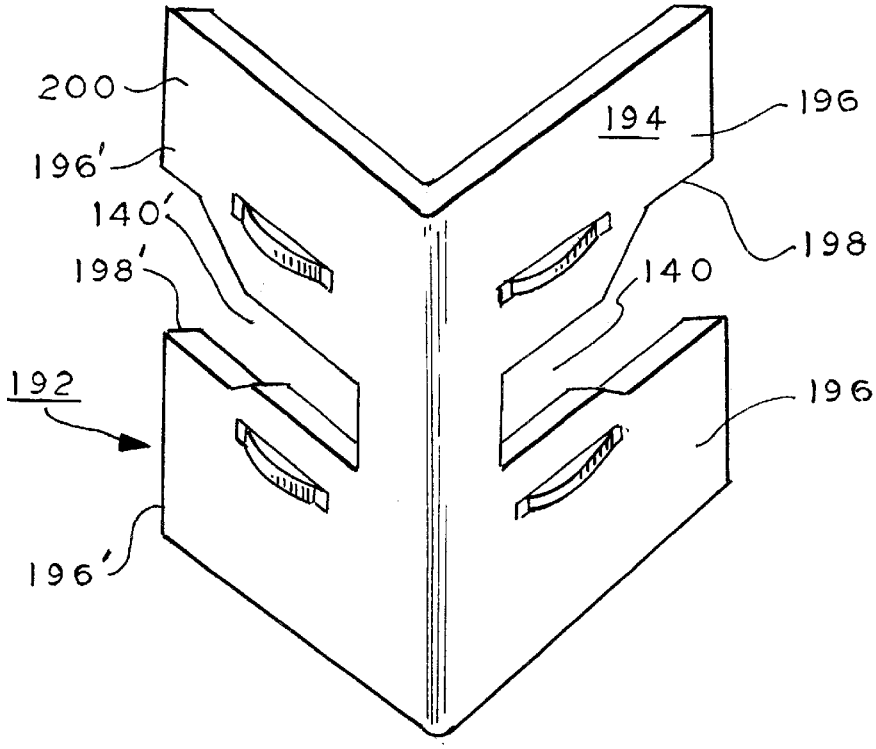
Figure 13:
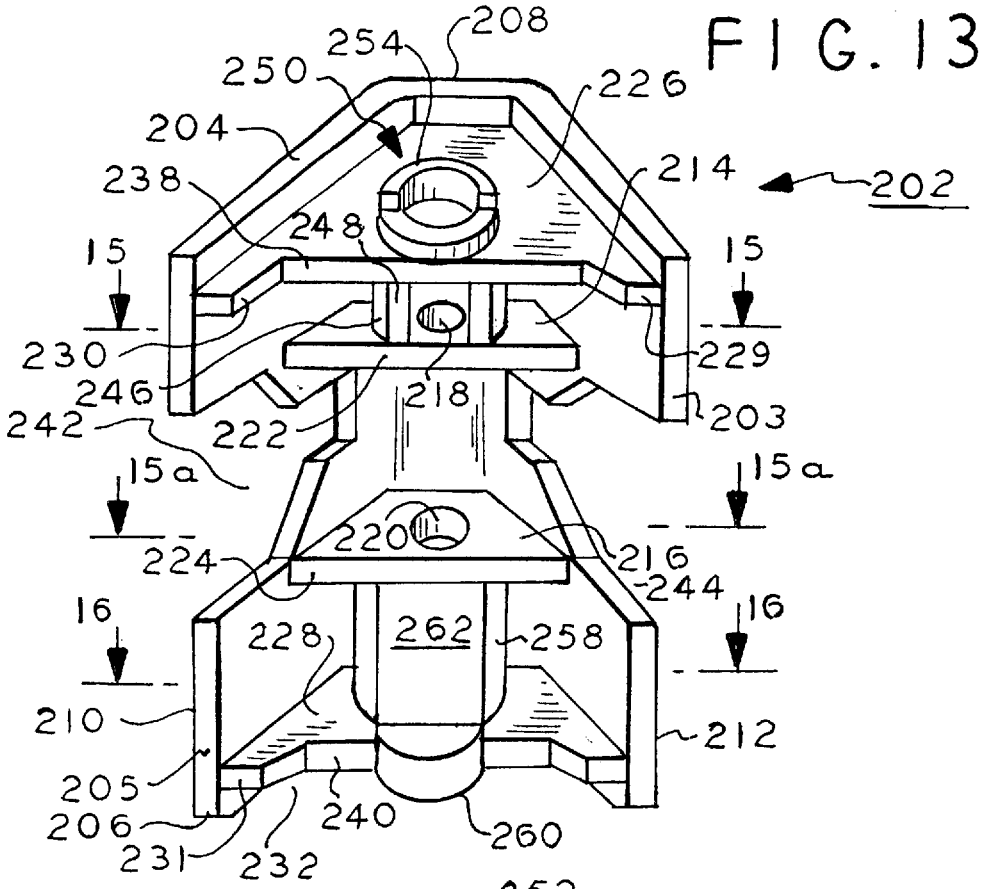
Figure 14:
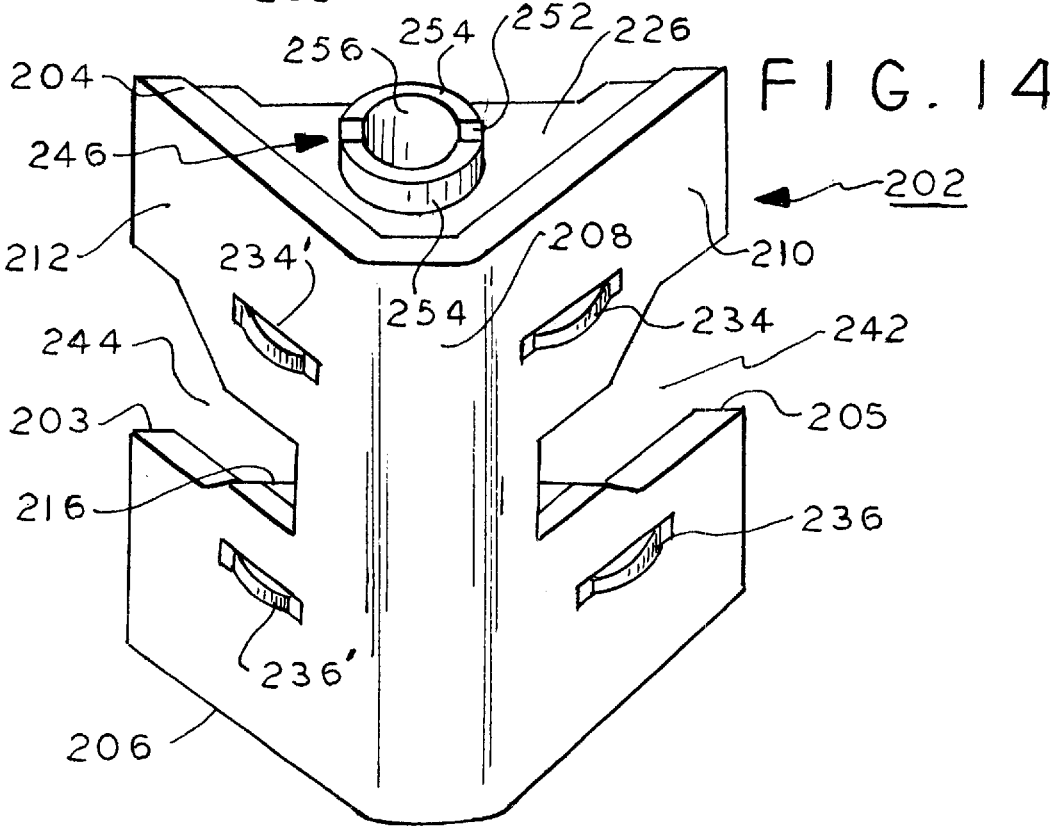
Figure 15:
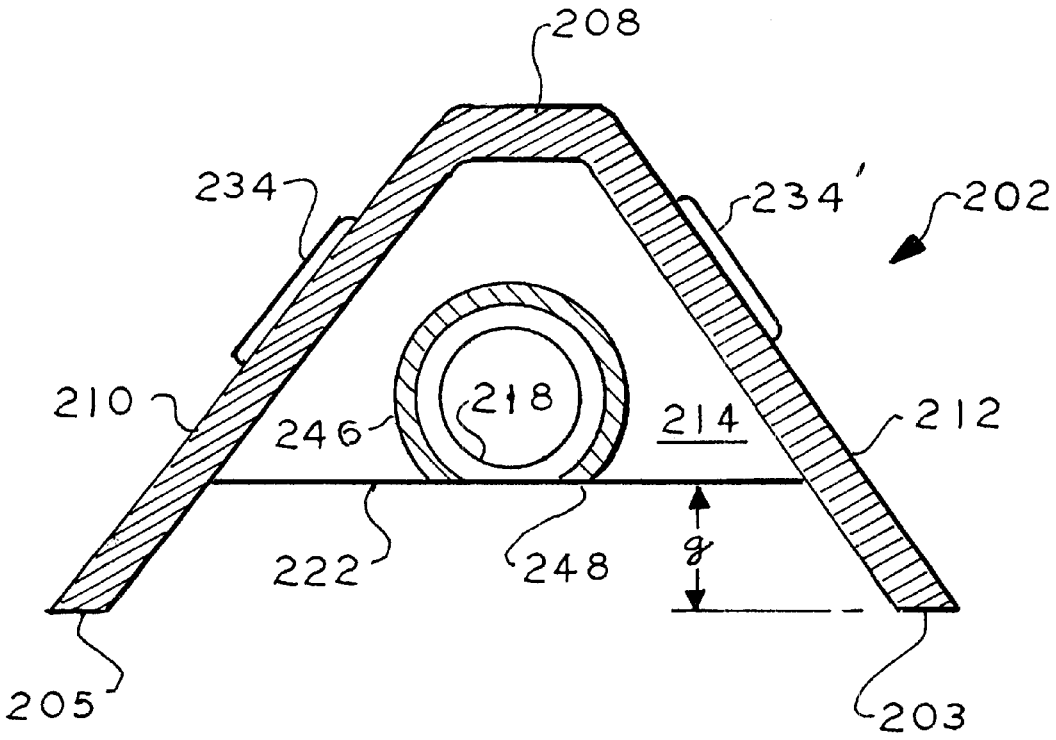
Figure 16:
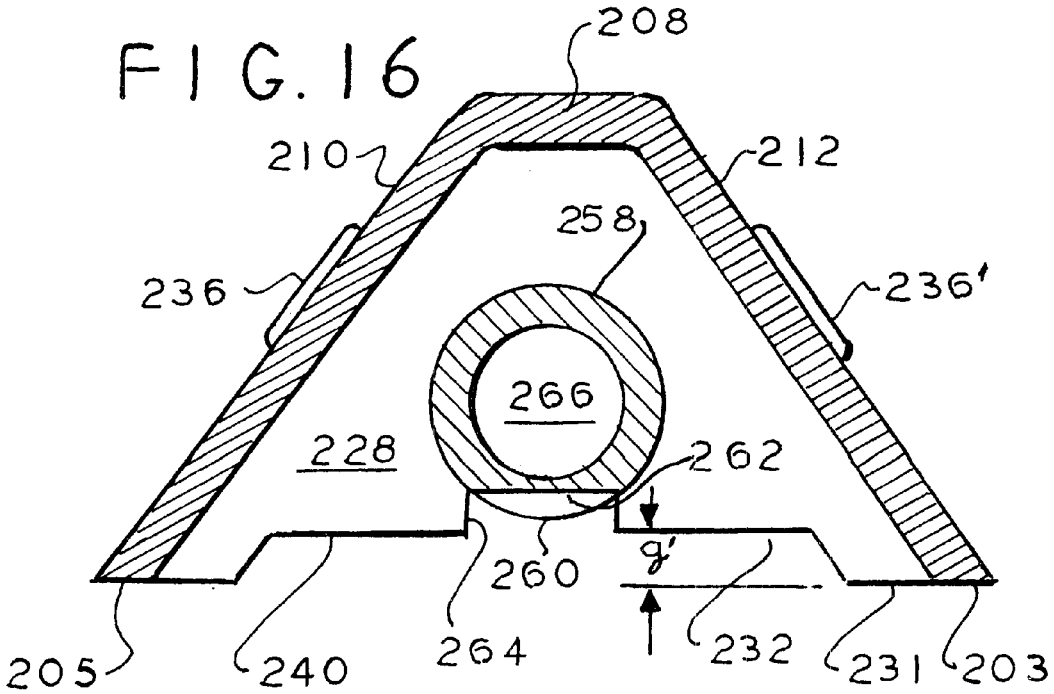
Figure 15A:
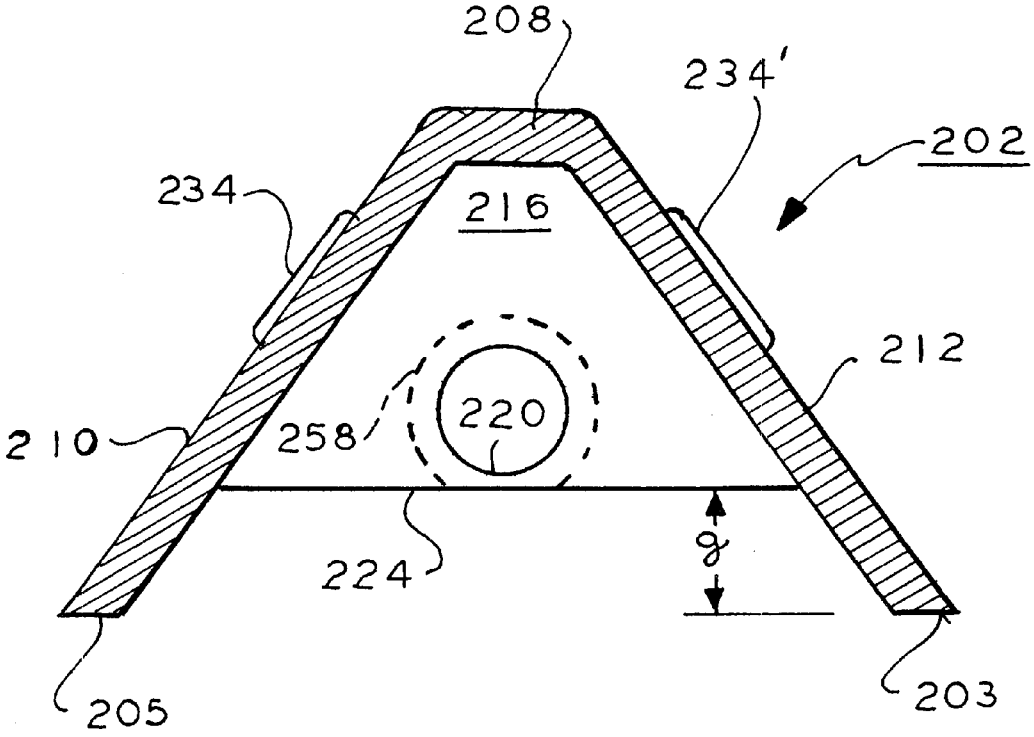
Figure 16A:
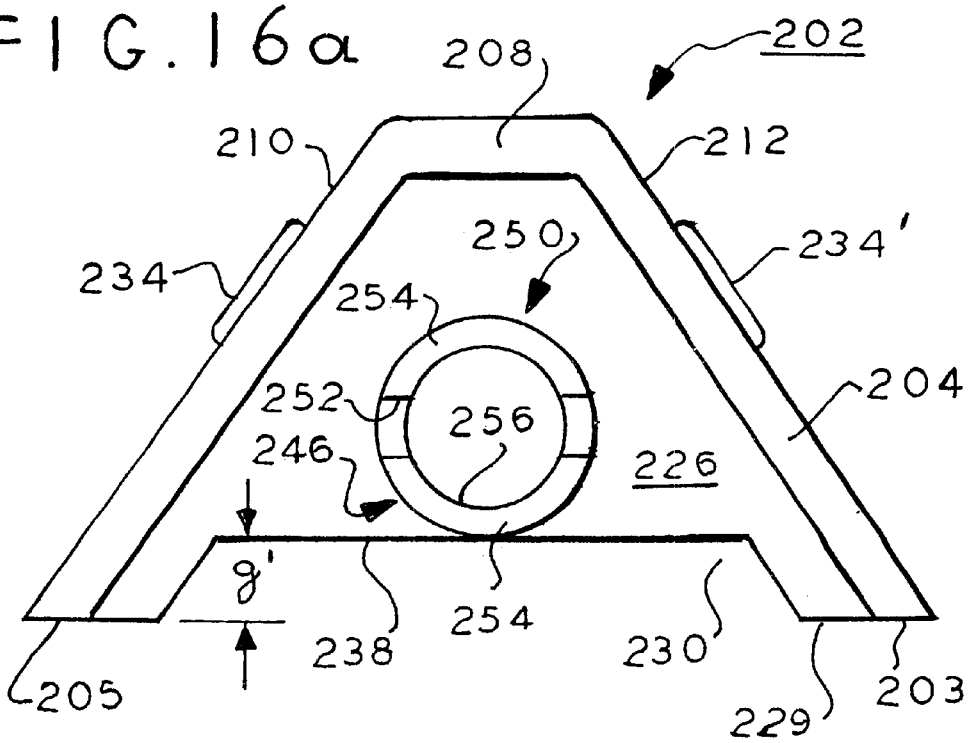

FIG. 4*c* is an isometric view of one type of keeper bar handle for use with the seal protector of the present invention;

FIGS. 5, 6*a*, 6 and 7 are respective rear perspective, top plan, front perspective and side elevation views of a seal protector according to a second embodiment of the present invention;

FIGS. 8 and 9 are respective rear and front perspective views of a seal protector of a third embodiment of the present invention;

FIGS. 10–12 are respective rear perspective, side elevation and front perspective views of a bolt seal protector of a fourth embodiment of the present invention;

FIGS. 13 and 14 are respective rear and front perspective views of a bolt seal protector of a fifth embodiment of the present invention;

FIGS. 15 and 16 are respective plan sectional views of the embodiment of FIG. 13 taken along lines 15—15 and 16—16, FIGS. 15*a* and 16*a* are respective plan views of the embodiment of FIG. 13 wherein FIG. 15*a* is a sectional plan view of wall 216 and FIG. 16*a* is a top plan view of the bolt seal protector of FIG. 13, FIGS. 17 and 18 are respective rear and front perspective views of a bolt seal protector of a sixth embodiment of the present invention;

FIG. 17*a* is a top plan view of the protector of FIGS. 17 and 18;

FIG. 17*b* is a sectional elevation view of the protector of FIG. 17*a* taken along lines 17*b*—17*b;*

Figure 21:
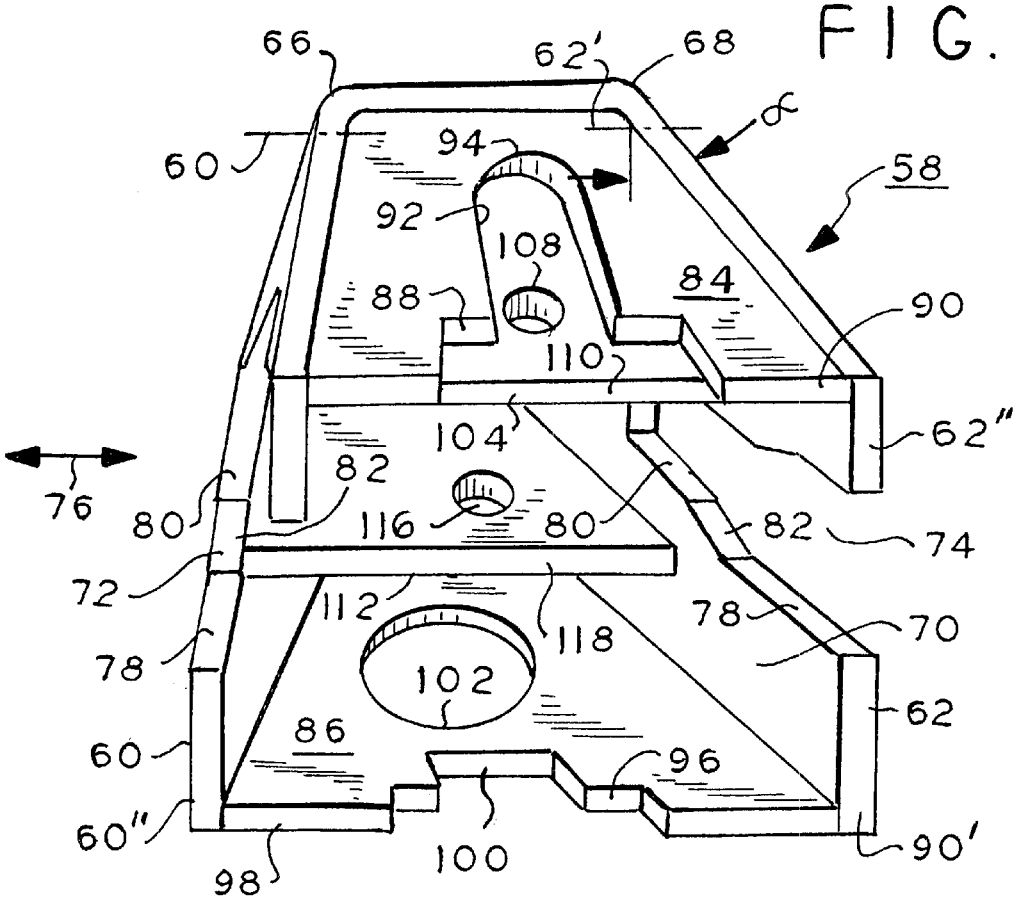
Figure 22:
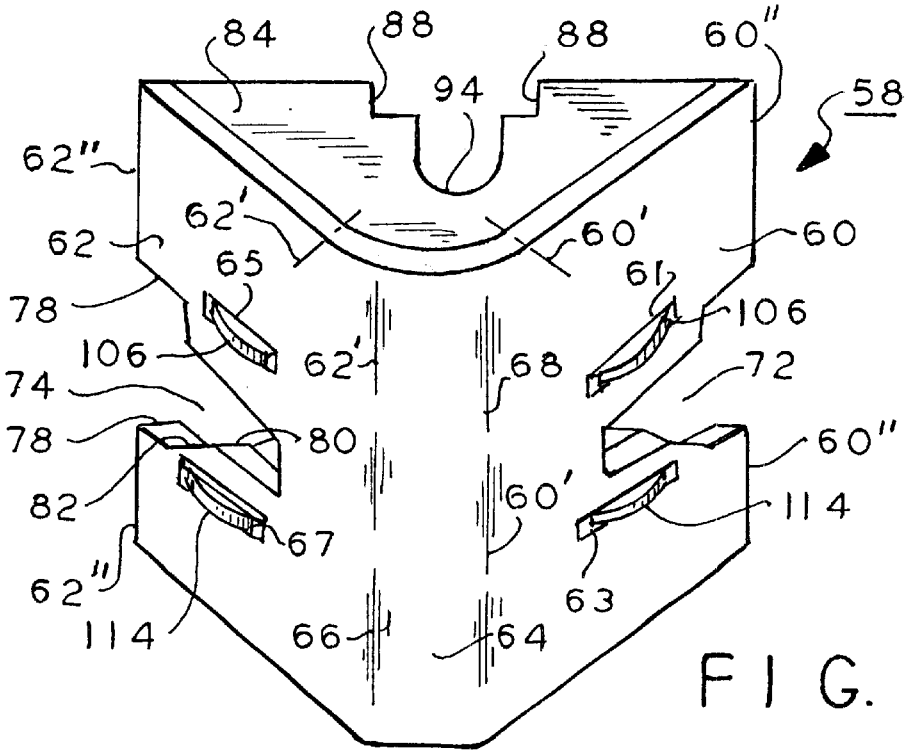
Figure 23:
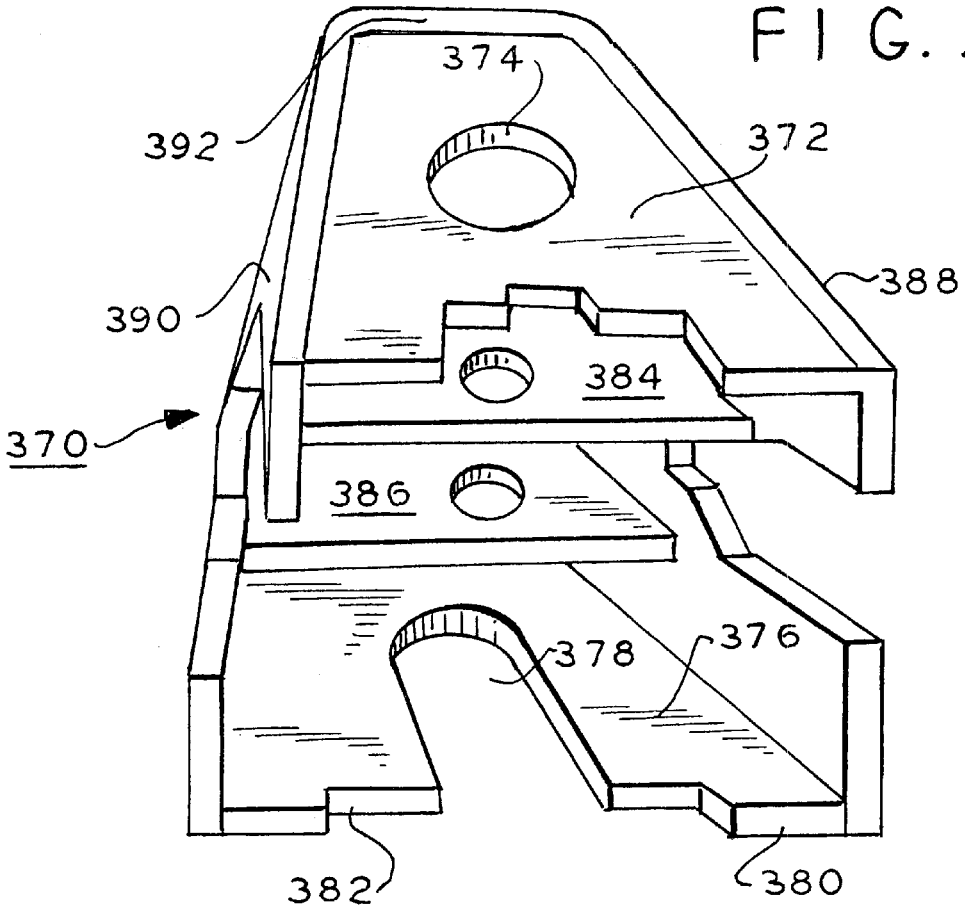
Figure 24:
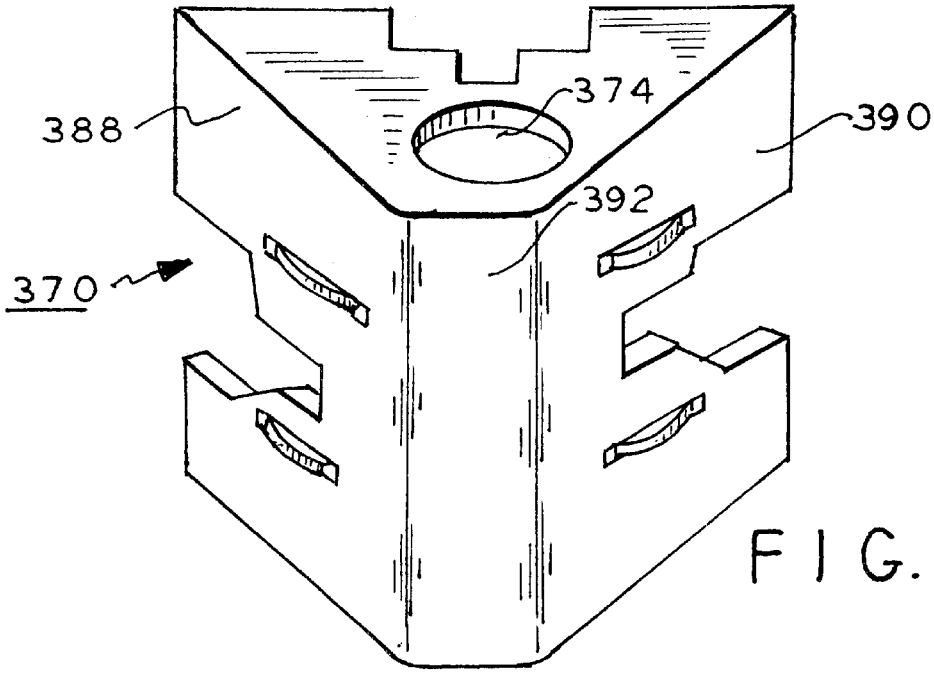
Figure 25:
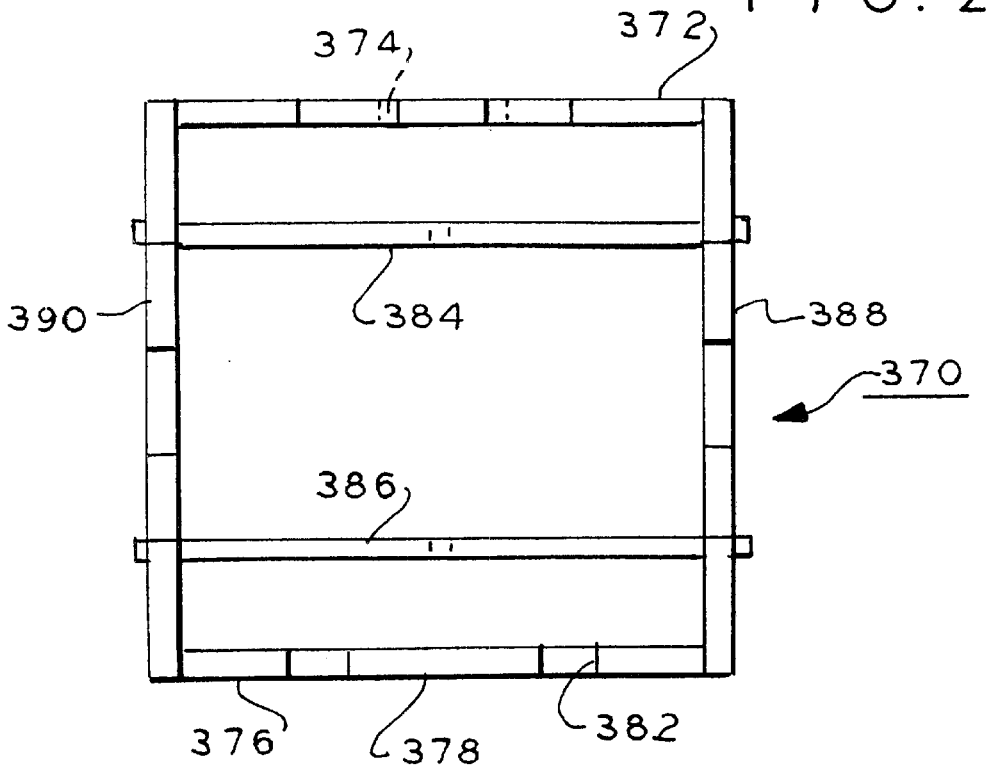
Figure 26:
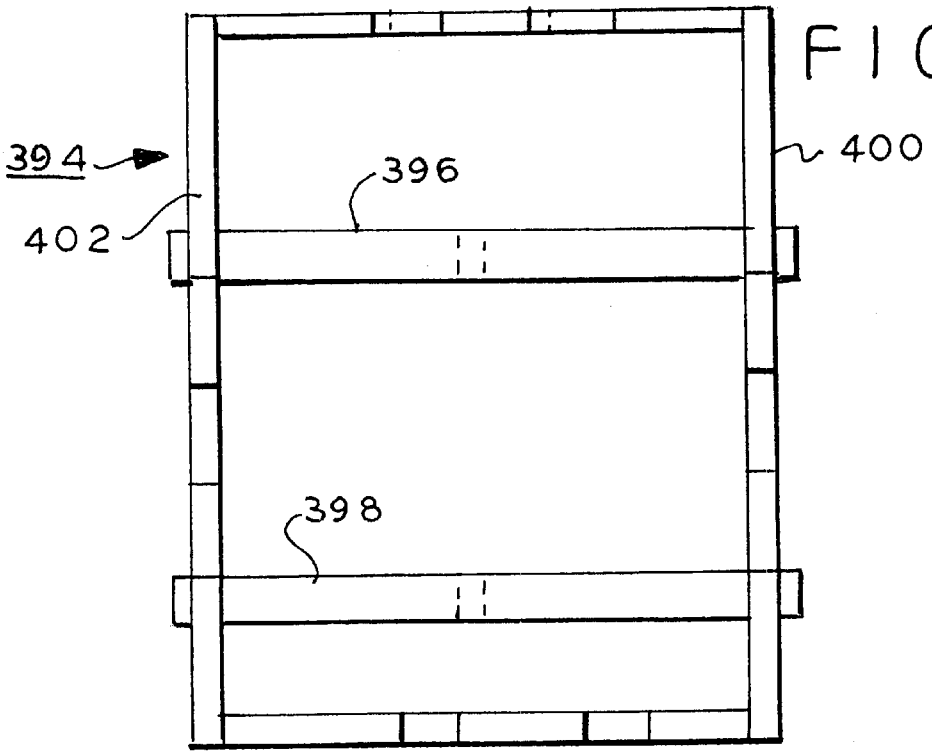
Figure 29:
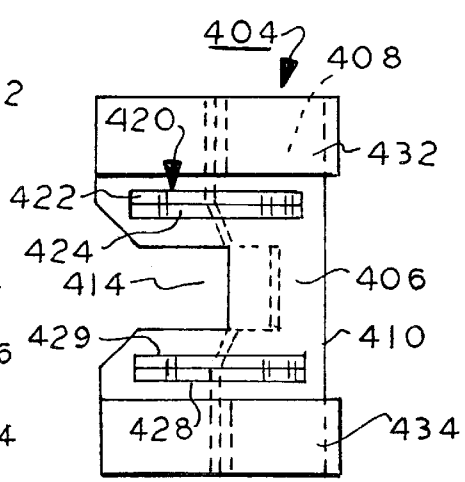
Figure 28:
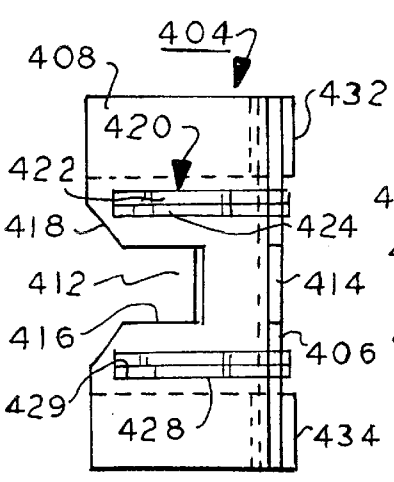
Figure 27:
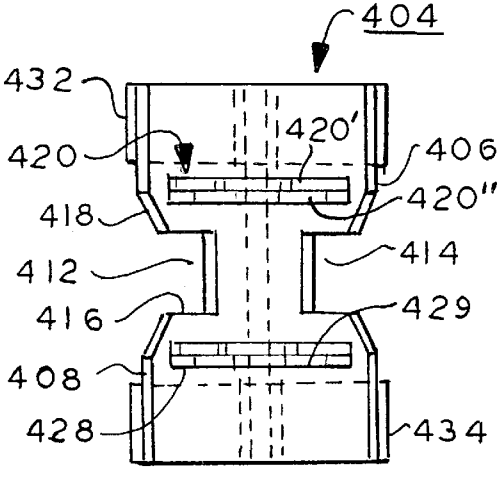
Figure 31:
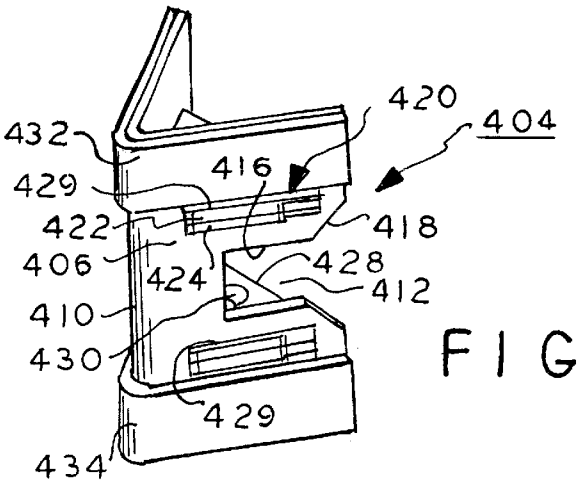
Figure 30:
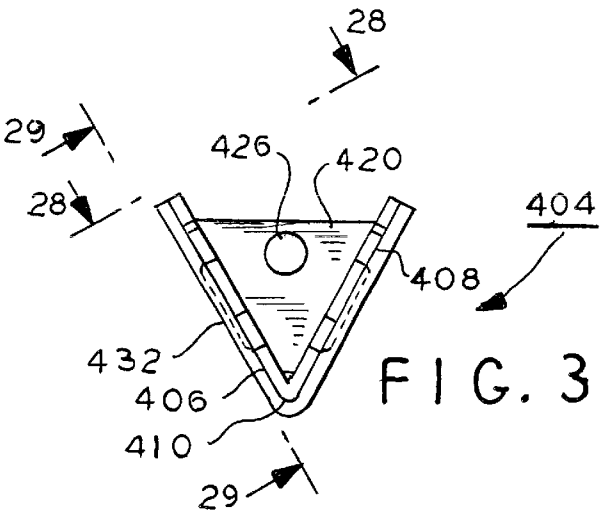

FIGS. 19 and 20 are respective rear and front perspective views of a bolt seal protector of a seventh embodiment of the present invention;

FIGS. 21 and 22 are respective rear and front perspective views of a bolt seal protector of according to the embodiment of FIGS. 1, 3 and 4;

FIGS. 23 and 24 are respective rear and front perspective views of a bolt seal protector of an eighth embodiment of the present invention;

FIGS. 25 and 26 are respective front elevation views of two different embodiments of the embodiment of FIGS. 23 and 24; and FIG. 27 is a rear elevation view of a protector according to a ninth embodiment;

FIG. 28 is an elevation view of the protector of FIG. 30 taken along lines 28—28;

FIG. 29 is an elevation view of the protector of FIG. 30 taken along lines 29—29;

FIG. 30 is a top plan view of the protector of FIG. 27;

FIG. 31 is a perspective view of the protector of FIG. 27; and

Figure 32:
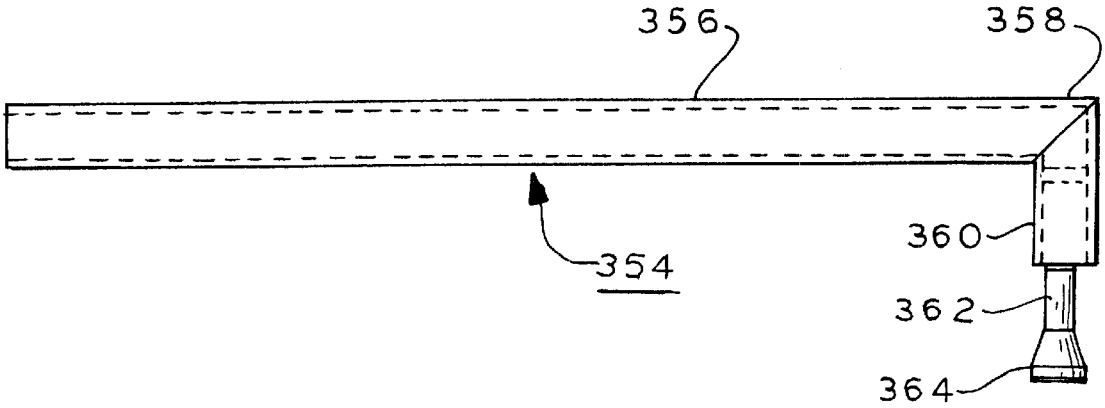
Figure 33:
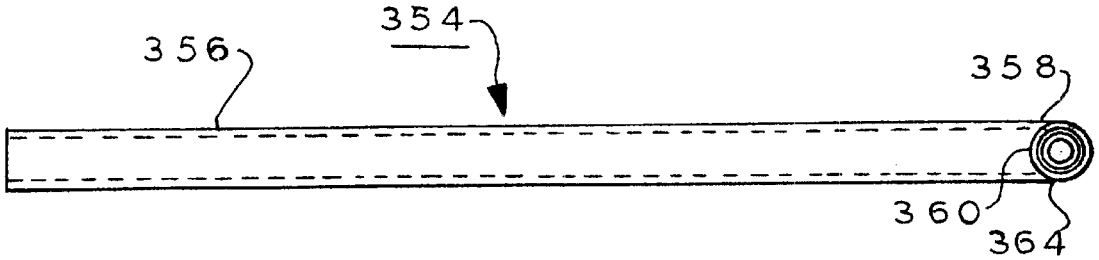

FIGS. 32 and 33 are respective side and bottom plan views of a tool useful with the embodiment of FIGS. 13–16.

In FIGS. 1, 3 and 4, a conventional door keeper bar assembly 10 includes a keeper bar 12. Bar 12 is a steel circular cylindrical rod, and which may be of other cross sectional shapes. The bar 12 has offset portions (not shown) at upper and lower ends for selectively engaging a catch (not shown) on a steel cargo container or cargo vehicle, e.g., a truck or trailer. The keeper bar assembly 10 secures door 14 closed (illustrated) in one angular position of the bar 12 and permits the door to be opened in a second angular position of the bar 12.

A handle 16 is pivotally pinned at pivot 18 to a bracket 20 welded to the bar 12. The handle 16 has a bent portion 22 as best seen in FIGS. 1 and 4*a*. Portion 22 bends somewhat closer to the door 14 than the rest of the handle which is spaced further away.

In FIG. 4*b*, a hasp 24 has two flange brackets 26, 28, which may be mirror images, and which have bends which cooperate to form a rectangular recess 30, each bracket forming a part of the recess 30. The recess 30 is between the bracket shoulder portions 26' and 28' and the door 14. The bracket 26 has a hasp portion 32 and the bracket 28 has a hasp portion 34. Portion 32 has an aperture 32' and portion 34 has an aperture 34', which apertures are juxtaposed. Bracket 26 is pivotally secured to door 14 by bolt 36. Bracket 28 is secured to the door 14 by a bolt 38, FIG. 3.

When a lock is passed through the hasp apertures 32' and 34' the handle 16 is locked in place in the recess 30. When the lock is removed, as in FIG. 4*b*, the bracket 26 can be rotated about bolt 36 releasing the handle 16. The handle 16 is then rotated about pivot 18 and lifted from the recess 30 portion formed by lower hasp bracket 28. Once free of the hasp 24, the handle is then used to pivot the keeper bar 12 about its longitudinal axis to unlock the door. Thus as long as the handle 16 is locked in the position of FIG. 4*b* and FIG. 1, the keeper bar can not be rotated and the door 14 remains locked. Therefore, locks are used to secure the hasp portions 32 and 34 closed in the position of FIG. 4*b*.

In FIG. 2, a bolt seal 40 includes a preferably steel generally circular cylindrical shank 42 having an enlarged head 44 at one end. The shank may be of other materials and has one (or more) grooves 46 which engage a locking mechanism (not shown) inside of the lock body 48, which groove(s) and body are conventional and may comprise bolt seals as disclosed in the patents noted in the introductory portion and incorporated by reference herein in their entirety.

The bolt seal 40 is vulnerable to tampering wherein the shank may be cut to open the lock. The seal protector of the present invention is to protect the seal from being severed or opened except by authorized users, who may either use an authorized tool for breaking the bolt head 44 from the shank 42 or which opens a locked bolt seal using a reusable lock body 48 as disclosed in certain of the aforementioned patents.

In FIG. 4*c* an alternative handle design is shown. The handle 50 is similar to the handle 16 except the handle 50 has a flange 52 in the recess formed by bent portion 54. An aperture 56 is in the flange 52. The aperture 56 aligns with the hasp 24 apertures such as apertures 32' and 34' (FIG. 4*b*) associated with the handle 50. Still other handle and hasp arrangements may be provided on the different commercially available keeper bar assemblies presently in use.

In FIG. 1, a bolt seal protector 58 of one embodiment is shown for use with the keeper bar assembly 10 and bolt seal 40 of FIGS. 1–4. As will be explained in detail below, the protector 58 is but one of a number of differently configured protectors for use with keeper bar assemblies having corresponding different configurations.

In FIGS. 21 and 22, bolt seal protector 58 is shown in more detail. Protector 58 comprises steel plates that are welded together. In the alternative, the protector may be bent from sheet steel or cast iron. Protector 58 has a first side wall 60, a second side wall 62 and a front wall 64. The walls 60, 62 and 64 are formed by bending a sheet of steel at side wall 60 front edge 60' at bend 68 and side wall 62 front edge 62' at bend 66. In the alternative, these walls may be separate sheets and welded together or formed as an iron casting as a unitary structure. The walls 60 and 62 each extend from the plane of the front wall 64 inclined at angle $\alpha$. The front wall 64 and the two side walls 60 and 62 form a trapezoidal space 70 therebetween. The front wall 64 is joined to the side walls 60 and 62 at respective side wall front edges 60' and 62'. The side walls 60 and 62 have respective rear edges 60" and 62". Side walls 60 and 62 have like respective slots 72 and 74. These slots are aligned in transverse directions 76 and are in communication with the rear edges 60" and 62" of the respective side walls. Representative slot 74 has a rear rectangular slot portion 78 terminating at rear edge 62". Slot 74 has a front rectangular slot portion 80. A trapezoidal slot portion 82 is medially the front and rear slot portions. These slots are dimensioned to receive the handle 16 as shown in FIG. 1.

The side wall 60 has two slots 61 and 63 extending front to rear. The side wall 62 has two slots 65 and 67 extending front to rear and aligned with the slots 61 and 63 respectively.

Protector 58 has a flat top wall 84 and a flat bottom wall 86. These walls are preferably made of steel as are the side and front walls or as a cast iron unitary structure. The top wall 84 and bottom wall 86 are both trapezoidal in plan view and are welded to the side walls 60 and 62 at the top and bottom wall side edges. The side walls 60 and 62 converge at front wall 64. The front wall 64 is joined to the bottom and top walls with welds. The front wall 64 is formed as one piece with the side walls which are bent at the comer bends 66 and 68 by suitable dies. In the alternative, the protector 58 may be made by casting. The front wall is narrower in transverse width than the spacing between the side walls at their rear edges 60" and 62".

The space 70 is trapezoidal in top plan view and forms a solid truncated pyramid with two parallel sides formed by the top and bottom walls and two inclined sides formed by side walls 60 and 62. The front of the space 70 is enclosed by all of the walls. The front wall 64 including the radii at the junction with the side walls is somewhat U-shaped forming a trough.

The top wall 84 has a rectangular recess 88 in communication with the rear edge 90 of the top wall. This recess 88 is dimensioned to receive the hasp bracket 26, FIG. 1. A slot 92 is in the top wall in communication with the recess 88 centrally of the recess. The slot 92 terminates in a semi-circular portion 94 which receives the head 44 (FIG. 2) of the bolt.

The bottom wall 86 has a rectangular recess 96 at the wall 86 rear edge 98. The recess 96 is dimensioned to receive the hasp bracket 28. In this way the protector 58 rear edges 60" and 62" can abut the door 14 (FIG. 1) when the protector is installed. Rear edges 90 and 98 of the top and bottom walls also preferably abut the door. The wall 86 has a central rectangular recess 100 in communication with recess 96. The recesses 88 in the top wall and 100 in the bottom wall also receive the hasp bracket or portions thereof in certain keeper assembly embodiments. The recesses 88 and 96 may be approximately the same dimensions, the drawing in this and other figures not being to scale. A circular aperture 102 is in the bottom wall aligned with the semi-circular portion 94 of slot 92 in the top wall. Aperture 102 receives the bolt seal body 48 (FIG. 1) which is located in the space 70 when locked to the bolt shank 42.

An intermediate steel plate wall 104 is located in the space 70 just above the slots 80 and 82 and extends toward the front wall parallel to the top and bottom walls. The wall 104 has projections 106, FIG. 22, which are located in corresponding slots 61 and 65. The projections 106 are welded to the corresponding side wall. Wall 104 has an aperture 108 aligned with semi-circular portion 94 in the top wall and aperture 102 in the bottom wall for receiving the bolt shank 42 therethrough. The wall 104 has a rear edge 110. This edge is recessed spaced from the plane of the side wall rear edges 60" and 62" a distance into the space 70. This recessed spacing is sufficient to receive the handle 16 bent portion 22, FIG. 1, and to provide a clearance for the hasp bracket 26 and 28, FIG. 4*b*. The wall 104 rear edge 110 is preferably located in a plane at about the junction of recesses 78 and 82, FIG. 21.

A second intermediate steel plate wall 112 is located in the space 70 just below the slots 80 and 82 and extends toward the front wall parallel to the top and bottom walls and plate 104. The wall 112 has projections 114, FIG. 22, located in corresponding slots 63 and 67. The projections 114 are welded to the corresponding side wall. Wall 112 has an aperture 116 aligned with semi-circular portion 94, aperture 102 in the bottom wall and aperture 108 in wall 104 for receiving the bolt shank 42 therethrough. The wall 112 has a rear edge 118. This edge is recessed spaced from the plane of the side wall rear edges 60" and 62" a distance into the space 70 the same as edge 110 of wall 104. This recessed spacing is sufficient to receive the handle 16 bent portion 22, FIG. 1. The wall 104 rear edge 110 is preferably located in a plane at about the junction of recesses 78 and 82, FIG. 21.

In operation, in FIG. 3, the protector is aligned with the hasp 24 and the bolt aligned with the apertures in the protector for insertion through the slot 92 in the top wall 84. The bolt is also aligned with the aperture 108 in the wall 104. The protector is then installed over the hasp 24 as shown in FIGS. 1 and 4. The bolt is then inserted through the aperture 116 in the intermediate wall 112. The lock body 48 is then attached to the bolt shank through the bottom wall aperture 102 and locked to the bolt. The shank and body are protected from cutting tools. The shank can only be accessed primarily along the bolt axis from the bottom which makes it difficult to break open the body. The bolt head is only accessible from the top through slot 92 which makes it difficult to break the bolt. A special authorized tool (not shown) may access the bolt head through the slot 92 to break the head free of the shank to open the bolt. The hasp and its bracket are enclosed by the side walls and walls 104 and 112 noting that normal bolt breaking tools can not access the space 70 through the side wall slots once the handle is in these slots.

Figure 6A:
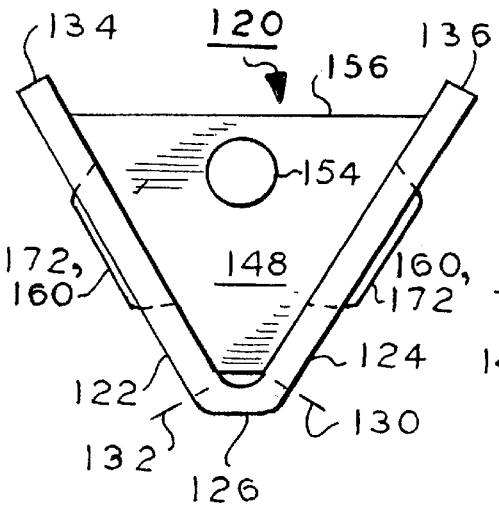
Figure 5:
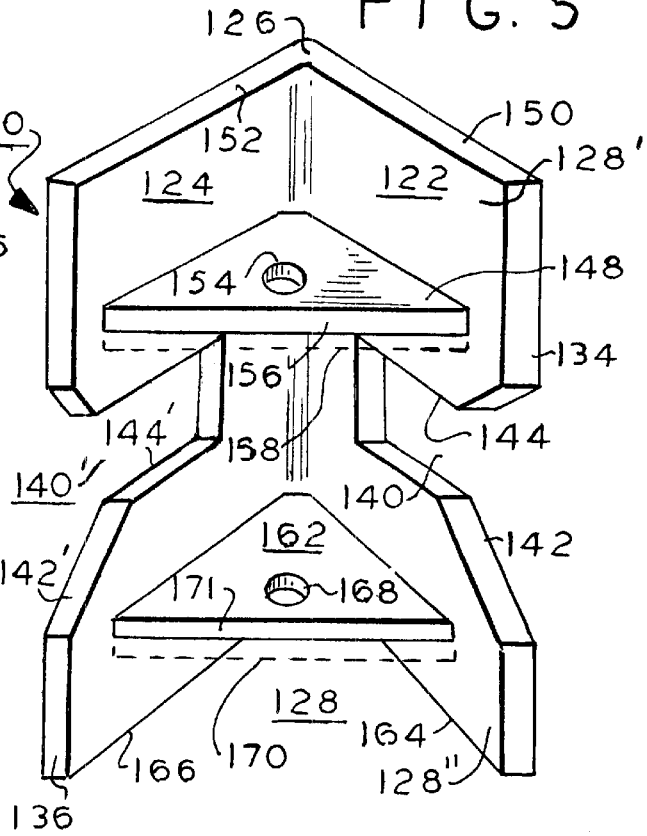
Figure 6:
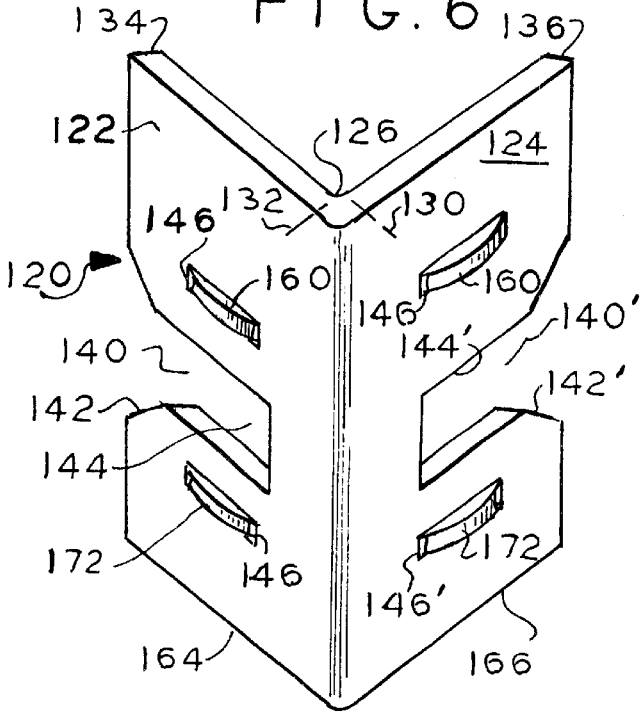
Figure 7:
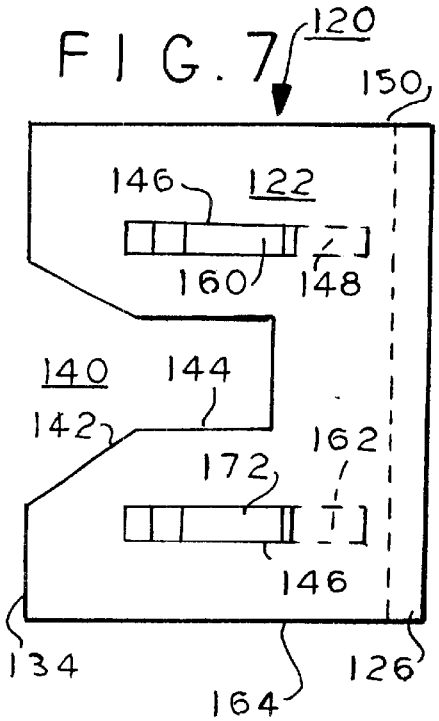

In FIGS. 5–7, another embodiment of a bolt seal protector is shown wherein protector 120 is V-shaped in plan view as best seen in FIG. 6*a*. Protector 120 comprises a sheet of steel that is bent to form side walls 122 and 124 connected by a generally U-shaped front wall 126 to form a triangular space 128. The side wall 124 may be considered to have an imaginary front edge 130 and the side wall 122 may be considered to have an imaginary front edge 132. The side wall 122 has a rear edge 134 and the side wall 124 has a rear edge 136.

The side wall 122 has a slot 140 in communication with rear edge 134. The slot 140 has a trapezoidal slot portion 142 and a rectangular slot portion 144 in communication with portion 142. The slot 140 is dimensioned to receive a keeper bar assembly handle such as handle 16, FIG. 1. The other side wall 124 has an identical slot as slot 140 wherein the slot in wall 124 have the same reference numerals as slot 140 but primed. Slot 140 may be of the same dimensions as the rectangular slot portion 80 and trapezoidal slot portion 82 of slot 74, FIG. 21.

The side walls each have a pair of spaced slots 146. A first sheet metal wall 148 is spaced between the side walls 122 and 124 somewhat above the slots 140 and 140' and between the slots 140 and 140' and the top edges 150 and 152 of respective side walls 122 and 124. The wall 148 is recessed substantially beneath the top edges 150 and 152. The wall 148 has a bolt shank receiving aperture 154. The wall 148 has a rear edge 156 that is recessed from the plane of the rear side wall edges 134 and 136 an amount sufficient to receive the hasp bracket when the rear edges 134 and 136 abut the door 14 (FIG. 1). The wall 148 may have different thickness as shown by the dashed line 158. The wall 148 is spaced beneath the top edges of the side walls sufficiently deep so that the bolt head is recessed in the space 128 portion 128' above, but adjacent to the wall 148. The wall 148 has projections 160 which mate in corresponding slots 146 and which projections are welded to abutting side walls.

A second sheet metal wall 162 is spaced between the side walls 122 and 124 somewhat below the slots 140 and 140' and between the slots 140 and 140' and the bottom edges 164 and 166 of respective side walls 122 and 124. The wall 162 is recessed substantially above the bottom edges 164 and 166. The wall 162 has a bolt shank receiving aperture 168. The wall 162 has a rear edge 171 that is recessed from the plane of the rear side wall edges 134 and 136 the same amount as wall 148 which edges lie in the same plane parallel to the plane of the side wall rear edges. The wall 162 may have different thickness as shown by the dashed line 170. The wall 162 is spaced above the bottom edges 164 and 166 of the side walls sufficiently deep so that the bolt body 48, FIG. 2, is recessed in the space 128 portion 128' below, but adjacent to the wall 162. The wall 162 has projections 172 which mate in corresponding slots 146 and which projections are welded to the abutting side walls.

In operation, the bolt 40 shank 42, FIG. 2, is inserted into the apertures 154 and 168 and through the hasp apertures with the hasp 24 between the walls 148 and 162. The hasp and its bracket are enclosed by the side walls and walls 148 and 162. The bolt shank is inaccessible with only the bolt head and bolt lock body accessible. The bolt may be of the releasable type mentioned in the introductory portion. The head may be broken from the shank by an authorized tool to release the handle and open the door.

In FIGS. 8 and 9, bolt protector 174 may be constructed the same as protector 120, FIGS. 5–7, except that protector 174 includes flanges 176 and 178. Flange 176 is a flat rectangular metal strip that is welded to side wall 180 at the side wall upper edge 182 and side wall 181 at upper edge 183. Preferably, the flange 176 comprises two pieces 184 and 186 welded to each other at joint 188 and then attached to a different side wall and the front wall as shown. Flange 178 is constructed similarly as flange 176 and attached to the side walls at their bottom edges as shown. The flanges provide a more robust protector housing. In the alternative, the side walls may each be formed separately and welded together at the front wall 190. The flanges 176 and 178 in this case are bent from the side wall sheet material. The side walls are then welded together at the front wall 188.

In FIGS. 10–12, the protector 192 may be the same construction as protector 120, FIGS. 5–7 except as follows. Side wall 194 has two spaced legs 196, square or rectangular, as needed for a given implementation, that are coplanar with and extend from the rear edges of the side wall 194. The two legs 196 form an extension of slot 140 forming a rectangular slot portion 198 for receiving a handle (not shown) different than that received by protector 120, FIG. 5. These legs provide additional protection for the bolt head, shank and lock body.

Side wall 200 is constructed in mirror image relation to side wall 194 wherein the same parts of wall 200 have the same reference numerals as wall 194 but primed.

The protector 202 of FIGS. 13 and 14 may be of generally of similar construction as the protector of FIGS. 5–7 except as follows. The protector 202 is somewhat taller from the top edge 204 to the bottom edges. Also the front wall 208 may be similar to the front wall in the embodiment of FIG. 21 or somewhat narrower between the side walls than that of the embodiment of FIGS. 21–22, but wider than the front wall of the embodiment of FIGS. 5–7. The side walls 210 and 212 and front wall 208 are bent from one piece of sheet metal. Intermediate walls 214 and 216 are constructed somewhat similarly as walls 148 and 162 of the FIG. 5 embodiment, protector 120. Walls 214 and 216 are welded at their edges to the adjacent side walls 210 and 212 and to front wall 208. In addition, projections 234 and 236 extending from respective walls 214 and 216 pass through adjacent openings in the respective side wall 210 are welded to the side wall 210. Similarly projections 234' and 236' extending from respective walls 214 and 216 pass through corresponding openings in the side wall 212 and are welded to this side wall.

The walls 214 and 216 are trapezoidal in plan view and have aligned bolt shank receiving respective apertures 218 and 220. These walls also have aligned rear edges 222 and 224, which are coplanar.

A top wall 226, FIG. 13, is recessed spaced below the top edge 204 and a bottom wall 228 is recessed spaced above the bottom edge 206. The top wall 226 and bottom wall 228 are welded to the opposite side walls 210 and 212 and to the front wall 208 at their peripheral edges. The top wall 226 has a rear edge 229, FIG. 16*a*. A recess 230 is formed in the rear edge 229. The bottom wall 228, FIG. 13, has a rear edge 231. A recess 232 is formed in the rear edge 231.

The side wall rear edges 203 and 205 and the top and bottom wall rear edges 229 and 231, FIG. 13, respectively, lie in a first plane. The rear edges 222, 224 of respective walls 214 and 216 are coplanar in a second plane. The rear edges 238 and 240 of the respective recesses 230 and 232, FIGS. 16 and 16*a*, are coplanar in a third plane. The first and second planes are spaced by a gap g, FIGS. 15 and 15*a*. Gap g is dimensioned to receive the hasp bracket such as bracket 26, FIG. 1, so that the side walls enclosed the bracket. The first and third planes are spaced a gap g', FIGS. 16 and 16*a* smaller than gap g. Gap g' also receives the particular hasp bracket associated with this protector, for example, a hasp for use on a shipping container or truck. The handle of the keeper assembly mates in the slots 242 and 244 in the side walls, FIGS. 13 and 14.

In the FIG. 13, the spacing between the walls intermediate wall 216 and bottom wall 228 is enlarged for purposes of illustration, as in practice, these walls may be closer together. Also, the intermediate walls 214 and top wall 226 may in practice be greater than that shown. For example, the spacing between the top wall and wall 214 may be about double the spacing between walls 216 and 228 depending upon a given implementation as compared to the spacings illustrated.

In FIGS. 13 and 15, a steel tube 246 is welded to wall 214 concentric with bolt shank aperture 218. The tube 246 is formed with a slot 248 in the rear side thereof. The slot 248 extends between intermediate wall 214 and top wall 226. This slot 248 is formed by removing a portion of the tube 26 to provide clearance for the hasp bracket in gap g, FIG. 15. The tube 246 extends beyond the top wall 226, FIGS. 13 and 16*a*, forming a top portion 250. Top portion 250 lies in the recessed space between the top edge 204 and the top wall 226. The portion 250 comprises bifurcated sections 254 formed by a transverse slot 252, FIG. 16*a*. The slot 252 permits a tool (not shown) for accessing a bolt head (not shown) which is positioned within the tube 246 and located just above wall 214. The tool (not shown) breaks the bolt free of the bolt shank.

The tube 246 is important for protecting the bolt head from being accessed by tampering with conventional pipes. There is insufficient clearance in the tube 246 for such pipes to access the bolt head and provide leverage to break the bolt head free of the shank. This provides exceptionally high security for such a bolt. The tube 246 has a conduit bore 256, FIG. 16*a*, which is sufficiently large in diameter for receiving the bolt head such as head 44, FIG. 2, and the tool.

In FIGS. 13, 15*a* and 16, a second steel tube 258 is welded to and between intermediate wall 216 and bottom wall 228. The tube 258 also depends below the bottom wall 228 forming depending portion 260. A rear face 262 of the tube 258 is removed between bottom wall 228 and intermediate wall 216 to provide clearance for the hasp bracket. A recess 264, FIG. 16, is formed in wall 228 to receive the portion 260. Tube 258 has a bore 266 for receiving the lock body such as body 48, FIG. 2. The recess 264 provides clearance for the bolt, rivets and so on that mount the hasp bracket to the door.

Tube 258 provides additional security in protecting the bolt from tampering over the protectors described previously hereinabove. The hasp is received in the space between the intermediate walls 214 and 216 as in the above embodiments. Only the bolt shaft and hasp is between these intermediate walls as in the prior embodiments. However, the bolt head at the top and the lock body at the bottom are further protected by tubes. The bolt shank is relatively inaccessible due to the presence of the hasp and handle in the space between the intermediate walls. Thus tampering tools can not readily access the shank through the slots 242 and 244 between the side walls and received handle and hasps. The hasps are aligned with the slots 242 and 244 in the space between the intermediate walls as in the prior embodiments described above herein severely limiting access to the bolt shank. No bolt shank is above wall 214 or below wall 216 above and below the intermediate walls, also as in the prior described embodiments, so the shank is not accessible for tampering with from the top and bottom in the region between the bolt head and lock body. While the shank might be accessible from the bottom at the exposed portion protruding from the lock body, damage to this exposed portion of the shank is harmless in respect of opening the bolt seal. The protector 202 provides enhanced robust protection to the locked bolt.

A tool 354 for use with the protector 202 is shown in FIGS. 32 and 33 and comprises an elongated handle 356 which is preferably a steel pipe terminating at mitered end 358. A relatively short steel pipe section 360 has a mating mitered end welded to end 358. A relatively smaller diameter tube or rod 362 of a desired length is welded to the end of section 360. A conical shaped bolt head receiving socket 364 is attached to the end of rod 362. The socket 364 has a hollow core which is shaped to receive the bolt head configuration. The rod 362 has a length such that the section 360 abuts the sections 254, FIGS. 13, 14, of the protector 202. The rod 362 fits inside of tube 246 bore 256. The socket 364 closely engages the bolt head adjacent to and abutting the wall 214. The rod has a diameter that is sufficiently small so as to fit in the slot 252 between the sections 254. This slot 252 permits the tool handle 356 to be tilted back and forth to the left and right in the drawing FIGS. 13 and 14 to break off the bolt head from the bolt shank. A pipe of normal diameter to fit in the bore 256 has no clearance to rock back and forth to break the bolt head free. The tool socket 364 and the length of the rod 362 are mated with the tube 246 of the protector 202 to permit such rocking.

In FIGS. 17, 17*a*, 17*b* and 18, a further embodiment of a bolt seal protector 270 comprises an intermediate section 272, a top section 274 and a bottom section 276. The top section 274 and bottom section 276 are mirror images of each other and otherwise identical.

Representative top section 274 comprises a left side wall 278, a right side wall 280 and a front wall 282. Wall 282 is V-shaped and forms the apex of the space formed by the side walls 278 and 280 which are V-shaped in orientation relative to each other. Wall 282 may be formed by a weld joint joining the side walls 278 and 280 and finished to provide a rounded surface or by bending a flat plate to form the walls. A flange 284 extends outwardly from wall 278 and a flange 286 extends outwardly from wall 280. As seen in FIG. 17*a*, the flanges terminate at linear edge 288 flush with the front wall 282. In practice, the flanges 284 and 286 and side walls 278 and 280 are formed from a one piece angle iron member or by casting. A notch is cut from the flange of the angle iron member. The notch forms edge 288 when the angle iron is bent at front wall 282. The angle iron is bent at an angle β, FIG. 17*a*, which may be about 60°. The angle between side walls in the prior described embodiments may also be about this angle value. The top section is representative of the bottom section 276 which are aligned above each other in spaced relation to each other. The bottom section has the same parts of the top section with the same reference numerals but primed. The intermediate section 272 is welded to the aligned top and bottom sections.

The intermediate section 272 comprises a bent steel plate forming a front wall 290, a left side wall 292 and a right side wall 294. The left side wall 292 has a slot 296 and the right side wall 294 has a slot 298. Slots 296 and 298 are shaped the same as slots 72 and 74, FIGS. 21 and 22 of the embodiment of protector 58. The dimensions of slots 296, 298 which are the same relative to each other may differ among the different embodiments to receive handles of corresponding shapes and dimensions. Slots 296 and 298 each have an interior rectangular slot portion 300, a rectangular exterior slot portion 302 and a trapezoidal intermediate slot portion 304 as in the embodiment of protector 58. The left side wall 292 is flush with the outer edge of flanges 284 and 284'. The right side wall 294 is flush with the outer edge of flanges 286 and 286'.

An intermediate wall 306 is triangular in plan view and is welded to the side walls 278 and 280 and front wall 282 coplanar with the flanges 284 and 286. Wall 306 has a bolt shank 42 receiving aperture 308. The wall 306 has a rear edge 310. Edge 310 is recessed from the plane of the sidewall 278 rear edge 312 and side wall 280 rear edge 314. The edge 310 recess is to receive the hasp bracket.

A second intermediate wall 316 is of the same shape and size as wall 306 and is also welded to the side and front walls. Wall 316 has a bolt shank receiving aperture 318 aligned with aperture 308.

In FIGS. 19 and 20, bolt protector 318 comprises a left side wall 320 and a right side wall 322 interconnected by a front wall 324. A slot 326 is in the left side wall 320 and a slot 328 is in the right side wall 322. The slots are preferably identical and aligned transversely as are all of the sidewall slots in the various embodiments herein. The slots may be the same as the slots 72 and 74 of the protector 58 of FIGS. 21 and 22. These slots include an interior and exterior rectangular slot portion in communication with an interior trapezoidal slot portion as described above. These slots are for receiving the handle of the keeper bar assembly.

The front wall 324 is flat and joined to the side walls by a respective bend or radius. The side walls and front wall are formed of one piece plate steel. The side wall 320 has an upper flange 330 and a bottom flange 332. These flanges are bent inwardly from the side wall 320 toward side wall 322. The flanges are formed with a radius at the side wall 320, are parallel to each other and normal to the side wall 320. The side wall 322 has an upper flange 334 and a bottom flange 336. The flanges 334 and 336 are bent inwardly from the side wall 322 forming a radius with the side wall 322, are parallel to each other and normal to the side wall 322. The flanges 334 and 336 are coplanar with and face flanges 330 and 332, respectively. Notches 338 are formed at the bends of the flanges where they join the front wall 324 and at which notches welds are formed.

The side wall 320 has slots 340 and 342 and the side wall 322 has slots 344 and 346. A trapezoidal steel plate wall 348 has projections 350 which mate in slots 340 and 344 and which projections are welded to the respective side walls. The wall 348 is also welded at its interior periphery to the respective side walls as are all corresponding interior walls of the different embodiments. Wall 348 has a bolt shank receiving aperture 352.

A second wall 364 identical to wall 348 is welded to the side walls 320 and 322. Wall 364 has projection 366 which mates in slot 342 in side wall 320 and a projection 368 which mates in slot 346 in side wall 322. These projections are welded to the corresponding side walls. The protector 318 is used by placement over the hasp and hasp bracket and the bolt then inserted into the apertures 352, 352' of the protector and through the hasp apertures located in the space between the walls 348 and 364. The bolt shank is protected on all sides by the side and front walls and by the handle in the slots 326 and 328. The hasp also protects the bolt from lateral tampering through the slots 326 and 328. The bolt head is accessible from the top and the lock body is accessible from the bottom for receiving a tool used in connection with a releasable bolt lock body. The flanges prevent undue access to the bolt head and to the lock body. In FIG. 26, the spacing between the plate 396 and the top edges is greater for the protector 394 than the spacing between the plate 384 and wall 372 for protector 370, FIG. 25 to provide enhanced protection for the seal bolt 40 and head 44, FIG. 2.

In FIGS. 23 and 24, protector 370 is somewhat similar to the protector 58 of FIGS. 21 and 22. In protector 370, the top wall 372 has an enlarged aperture 374 for receiving the bolt head. The bottom wall 376 has a slot 378 in communication with the bottom wall rear edge 380 via recess 382. The slot 378 receives the lock body. Intermediate walls 384 and 386 have bolt shank receiving apertures aligned with the slot 378 and aperture 374. The structure is otherwise the same as that of protector 58.

In FIG. 25, the protector 370 has intermediate walls 384 and 386 which are of the same thickness and are about the same thickness as the side walls 388 and 390, top wall 372 and bottom wall 376, the drawing not being to scale.

In FIG. 26, protector 394 has the same overall configuration as protector 370 of FIGS. 23 and 24. The exception is that the intermediate walls 396 and 398 are double the thickness of intermediate walls 384 and 386 of the FIG. 25 embodiment. Further, the side walls 400 and 402 are taller in the direction from the bottom of the figure to the top than the side walls of the embodiment of protector 370. The apertures, slots and recesses otherwise are the same as the protector 370. The protector 394 is used with a keeper bar assembly of different dimensions than the keeper bar assembly with which the protector 370 is used. As noted previously, numerous different keeper bar assemblies are in the field and the disclosed embodiments are intended to be used with such different assemblies. The thicker plates forming walls 396 and 398 provide a more robust secure protector than protector 370 and is used where a need for such a more secure protector is recognized by past experience with tampering in a given environment, for example. All of the embodiments disclosed herein may have walls of increased or reduced thicknesses according to a given need.

In FIGS. 27–31 protector 404 comprises side walls 406 and 408 and front wall 410. Side walls 406 and 408 are formed from a bent steel plate wherein the front wall 410 is the bend region. The side walls are bent at an angle of about 60° to each other as are all of the side walls relative to each other in the different embodiments described hereinabove. Handle receiving slots 412 and 414 comprising a rectangular portion 416 and a trapezoid portion 418 in communication with the side wall rear edges are formed in each side wall. This is as described above in more detail in connection with the embodiment of protector 120, FIG. 5.

An upper wall 420 is trapezoidal in plan view. Wall 420 comprises two steel plates 420' and 420" overlying each other to form a double thickness wall. Wall 420 is welded to the adjacent side walls. Each plate of wall 420 has respective projections 422 and 424 extending therefrom. These projections mate in corresponding slots 429, respectively, in the side walls and extend beyond the side walls in the same manner as described in the above embodiments. The projections are welded to the side walls on the side wall exteriors and the plates are welded to the side walls in the interior regions. Wall 420 has a shank receiving aperture 426. Wall 420 is above the slot 412.

A lower wall 428 is constructed the same as upper wall 420 and attached to the side walls in the same manner. Wall 428 is below the slot 412 and parallel to wall 420. Wall 428 has a shank receiving aperture 430 aligned with the aperture 426.

A reinforcement steel plate band 432 is welded to the exterior of walls 406, 408 and 410. Band 432 is attached at the top edge of the side and front walls. An identical reinforcement steel plate band 434 is attached to the exterior of walls 406, 408 and 410 at the bottom edge of the side and front walls. The bands 432 and 434 are steel plates that are bent to conform to be complementary to the side and front walls.

There thus has been shown various embodiments of bolt seal protectors for use with keeper bar assemblies of differing configurations and dimensions and having differing security levels of protection. Such differing levels of protection are provided by providing walls of different thicknesses and additional walls and protective structures according to a given security need. Reinforcing ribs, flanges and the like are provided to enhance the protection afforded to a locked bolt. Each protector has an open rear face for receiving the hasp and hasp support bracket for protecting the hasp. Recesses are provided in the protector rear edges to receive hasp brackets and hasp hardware such as pins, rivets and the like used to attach the hasp brackets to a support such as a door. Such recesses include for example recesses 88, 96 and 100 of the protector 58 of the embodiment of FIGS. 21 and 22, for example. The structures are robust and comprise welded steel plates or metal castings which are difficult to break into. A tool is disclosed in FIGS. 32 and 33 for use with the protector of FIGS. 13 and 14 to provide further enhanced protection.

It will occur to one of ordinary skill that various modifications may be made to the disclosed embodiments. Such embodiments are given by way of illustration and not limitation. It is intended that the scope of the invention be defined by the appended claims.

What is claimed is:

1. A seal protector for protecting a locked bolt seal, the seal comprising a shank, a head at a first shank end and a lock body for locking attachment to the shank at a second shank end, the shank for passing through a hasp having a first bolt receiving aperture, the hasp being coupled to a locking handle associated with a door, said hasp including a support bracket secured to said door, the protector comprising:

a front wall;

first and second side walls each extending from the front wall at a side wall front edge to a side wall rear edge and inclined relative to each other and to the front wall to form a space therebetween, the space formed by and between the side walls and front wall being one of a triangle and trapezoid in a plane normal to the walls, the side walls each having a slot in communication with the rear edge of each side wall for receiving at least the handle therein, the space having an open rear face distal the front wall for receiving the hasp therethrough;

a third wall secured to the side walls in said space, the third wall having a second aperture for alignment with the first aperture of the hasp received in the space; and a fourth wall secured to the side walls in said space and having a third aperture aligned with the second aperture and for alignment with the first aperture, the first, second and third apertures for receiving the bolt therethrough, the third and fourth walls defining a chamber for receiving the handle and hasp.

2. The seal protector of claim 1 wherein the side walls have rear edges lying in a plane, the third and fourth walls having respective rear edges located recessed in the space spaced from the plane for permitting the hasp bracket lying in said plane to be received in said space.

3. The seal protector of claim 1 wherein the side walls have top and bottom edges, the top edges being coextensive and the bottom edges being coextensive, the front wall extending to and between the top and bottom edges, the front wall being curved in the region between and attached to the front edges of the side walls to form said space.

4. The seal protector of claim 1 wherein the front wall defines a trough.

5. The seal protector of claim 1 wherein the side walls are spaced apart a distance sufficient to receive the hasp bracket in the space.

6. The seal protector of claim 1 wherein the third and fourth walls lie in respective planes and are positioned in said space to permit said hasp bracket to be received in said space between said planes.

7. The seal protector of claim 1 wherein the slots have a first portion of a first shape at the side walls rear edges and a second portion interior the first portion relative to the rear edges.

8. The seal protector of claim 1 wherein the front wall comprises a planar wall of a first transverse width, the rear edges of the side walls being spaced apart a second transverse width, greater than the first transverse width to form the space into a trapezoid in said plane.

9. The seal protector of claim 1 further including a flange extending outwardly from each side wall away from said space or inwardly into said space.

10. The seal protector of claim 1 wherein the side walls each have top and bottom edges, further including a flange extending inwardly from each side wall into said space at each said side wall top and bottom edges.

11. The seal protector of claim 1 wherein the side walls have top and bottom edges, and wherein each slot has a first portion of a given configuration in communication with its corresponding side wall rear edge, each slot having a second portion in communication with the first portion and interior the first portion relative to said rear edges, and each slot having a third portion interior the second portion and closest to the front wall, the first portion in a direction from the top to bottom edges having a height greater than that of the third portion, the second portion of each slot being of a different configuration than the first portion given configuration.

12. The seal protector of claim 1 wherein each said slots have first and second edges, further including a first flange extending outwardly from the first side wall slot at its first edge and a second flange extending outwardly from the second side wall slot at its first edge, a third flange extending outwardly from the first side wall slot at its second edge and a fourth flange extending outwardly from the second side wall slot at its second edge.

13. The seal protector of claim 12 wherein the first and second flanges and third wall are coplanar and the third and fourth flanges are coplanar with the fourth wall.

14. The seal protector of claim 12 wherein the flanges each form an edge of its corresponding slot and form a continuous planar surface with the respective third and fourth walls.

15. The seal protector of claim 12 wherein the front wall and side walls each have top and bottom edges, the flanges each terminating at a flange outer edge, the front wall and the first and second side walls each having first, second and third portions, the second portion being medially the first and third portions, the first portion terminating at the top edge and the third portion terminating at the bottom edge, the second portion extending from the outer edge of each said flanges.

16. The seal protector of claim 1 wherein the side and front walls each have coplanar top and bottom edges, further including a top wall overlying said space and extending inwardly from each said side walls at said top edges and a bottom wall extending inwardly from each said side walls at said bottom edges and overlying said space, the top and bottom walls each having an opening therethrough aligned with the second and third apertures.

17. The seal protector of claim 16 wherein each said top and bottom walls have a rear edge coextensive with the rear edge of the first and second side walls, each said top and bottom wall rear edges having a recess adapted to receive the hasp support bracket therein.

18. The seal protector of claim 16 wherein the top wall opening is of sufficiently large cross section dimension to receive the bolt head and the first and second apertures are of smaller diameter than that of the cross section dimension of the top wall opening, the bottom wall opening being sufficiently large in cross section dimension to receive said lock body.

19. The seal protector of claim 17 wherein the top wall opening is a slot in communication with the top wall recess.

20. The seal protector of claim 17 wherein the top and bottom wall recesses are aligned and of different shapes.

21. The seal protector of claim 17 wherein the bottom wall opening is a slot in communication with the bottom wall recess.

22. The seal protector of claim 1 wherein the first and second side wall rear edges terminate in a plane, the third and fourth walls each have a rear edge that is recessed toward the front wall relative to the plane.

23. The seal protector of claim 16 wherein the top and bottom walls have a surface that is coplanar with said top and bottom edges.

24. The seal protector of claim 16 including a conduit member attached to and between the top wall and the third wall and defining a conduit aligned with and contiguous with the top wall opening and the second aperture.

25. The seal protector of claim 16 including a conduit member attached to and between the bottom wall and the fourth wall and defining a conduit aligned with and contiguous with the bottom wall opening and the third aperture.

26. The seal protector of claim 16 including a first conduit member attached to and between the top wall and the third wall and defining a first conduit aligned with and contiguous with the top wall opening and the second aperture and a second conduit member attached to and between the bottom wall and the fourth wall and defining a second conduit aligned with and contiguous with the bottom wall opening, with the third aperture and with the first conduit.

27. The seal protector of claim 16 wherein the top and bottom walls have a first thickness and the third and fourth walls have a second thickness, the first and second thicknesses being about the same value.

28. The seal protector of claim 16 wherein the top and bottom walls have a first thickness and the third and fourth walls have a second thickness, the first and second thicknesses being different in value.

29. The seal protector of claim 28 wherein the third and fourth walls are thicker than the top and bottom walls.

30. The seal protector of claim 24 wherein the conduit extends above the top wall, the conduit extending above the top wall in two spaced sections for forming a tool receiving clearance between the spaced sections.

31. A seal protector for protecting a locked bolt seal, the seal comprising a shank, a head at a first shank end and a lock body for locking attachment to the shank at a second shank end, the shank for passing through a hasp having a first bolt receiving aperture, the hasp being coupled to a locking handle associated with a door, said hasp including a support bracket secured to said door, the protector comprising:

a front wall;

first and second side walls each extending from the front wall at a side wall front edge to a side wall rear edge and inclined relative to each other and to the front wall to form a space therebetween, the space between the side walls and front wall being one of a triangle and trapezoid in a plane normal to the side walls, the side walls each having a slot aligned transversely with each other and in communication with the rear edge of each side wall for receiving the handle therein, the slots having first and second spaced edges, the space having an open rear face distal the front wall for receiving the hasp therethrough;

a third wall in said space secured to the side walls at the slot first edges, the third wall having a second aperture for alignment with the first aperture of the hasp received in the space; and a fourth wall in said space secured to the side walls at the slot second edges and having a third aperture aligned with the second aperture and for alignment with the first aperture, the first, second and third apertures for receiving the bolt therethrough, the third and fourth walls defining a chamber for receiving the handle and hasp;

the side walls having rear edges lying in a plane, the third and fourth walls having respective rear edges located recessed in the space spaced from the plane for permitting the hasp bracket lying in said plane to be received in said space.

32. A seal protector for protecting a locked bolt seal, the seal comprising a shank, a head at a first shank end and a lock body for locking attachment to the shank at a second shank end, the shank for passing through a hasp having a first bolt receiving aperture, the hasp being coupled to a locking handle associated with a door, said hasp including a support bracket secured to said door, the protector comprising:

a front wall;

first and second side walls each extending from the front wall at a side wall front edge to a side wall rear edge and inclined relative to each other and to the front wall to form a space therebetween, the space between the side walls and front wall being triangular wherein the front wall is one of a U-shape and V-shape in transverse section, the side walls each having a slot in communication with the rear edge of each side wall for receiving the handle therein, the space having an open rear face distal the front wall for receiving the hasp therethrough;

a third wall in said space secured to the side walls, the third wall having a second aperture for alignment with the first aperture of the hasp received in the space; and a fourth wall in said space secured to the side walls and having a third aperture aligned with the second aperture and for alignment with the first aperture, the first, second and third apertures for receiving the bolt therethrough, the third and fourth walls defining a chamber for receiving the handle and hasp.

33. A seal protector for protecting a locked bolt seal, the seal comprising a shank, a head at a first shank end and a lock body for locking attachment to the shank at a second shank end, the shank for passing through a hasp having a first bolt receiving aperture, the hasp being coupled to a locking handle associated with a door, said hasp including a support bracket secured to said door, the protector comprising:

a front wall;

first and second side walls each extending from the front wall at a side wall front edge to a side wall rear edge and inclined relative to each other and to the front wall to form a space therebetween, the space between the side walls and front wall being trapezoidal wherein the front wall has a transverse dimension between said side walls smaller than the transverse dimension of the space between said side walls at said side wall rear edges, the side walls each having a slot in communication with the rear edge of each side wall for receiving the handle therein, the space having an open rear face distal the front wall for receiving the hasp therethrough;

a third wall in said space secured to the side walls, the third wall having a second aperture for alignment with the first aperture of the hasp received in the space; and a fourth wall in said space secured to the side walls spaced from the third wall for receiving the hasp therebetween and having a third aperture aligned with the second aperture and for alignment with the first aperture, the first, second and third apertures for receiving the bolt therethrough, the third and fourth walls defining a chamber for receiving the handle and hasp.

34. A seal protector for protecting a locked bolt seal, the seal comprising a shank, a head at a first shank end and a lock body for locking attachment to the shank at a second shank end, the shank for passing through a hasp having a first bolt receiving aperture, the hasp being coupled to a locking handle associated with a door, said hasp including a support bracket secured to said door, the protector comprising:

a front wall;

first and second side walls each extending from the front wall at a side wall front edge to a side wall rear edge and inclined relative to each other and to the front wall to form a space therebetween, the space between the side walls and front wall being one of trapezoidal and triangular, the side walls each having a slot in communication with the rear edge of each side wall for receiving the handle therein, the slots having first and second spaced edges, the space having an open rear face distal the front wall for receiving the hasp therethrough;

a third wall in said space secured to the side walls at the slot first edges, the third wall having a second aperture for alignment with the first aperture of the hasp received in the space;

a fourth wall in said space secured to the side walls at the slot second edges and having a third aperture aligned with the second aperture and for alignment with the first aperture, the first, second and third apertures for receiving the bolt therethrough, the third and fourth walls defining a chamber for receiving the handle and hasp.

* * * * *